US010019933B2

(12) United States Patent
Takahara

(10) Patent No.: US 10,019,933 B2
(45) Date of Patent: Jul. 10, 2018

(54) EL DISPLAY APPARATUS

(71) Applicant: JOLED INC., Tokyo (JP)

(72) Inventor: Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/124,467

(22) PCT Filed: Dec. 24, 2014

(86) PCT No.: PCT/JP2014/006438
§ 371 (c)(1),
(2) Date: Sep. 8, 2016

(87) PCT Pub. No.: WO2015/136588
PCT Pub. Date: Sep. 17, 2015

(65) Prior Publication Data

US 2017/0018220 A1 Jan. 19, 2017

(30) Foreign Application Priority Data

Mar. 13, 2014 (JP) ..... 2014-050896

(51) Int. Cl.
*G09G 3/30* (2006.01)
*G09G 3/3233* (2016.01)
*G09G 3/3266* (2016.01)

(52) U.S. Cl.
CPC ..... *G09G 3/30* (2013.01); *G09G 3/3233* (2013.01); *G09G 3/3266* (2013.01); *G09G 2300/0819* (2013.01); *G09G 2300/0852* (2013.01); *G09G 2310/0254* (2013.01); *G09G 2310/0256* (2013.01); *G09G 2310/0262* (2013.01); *G09G 2310/0267* (2013.01);
(Continued)

(58) Field of Classification Search
None
See application file for complete search history.

(56) References Cited

U.S. PATENT DOCUMENTS

2006/0007072 A1 1/2006 Choi et al.
2007/0268210 A1 11/2007 Uchino et al.
(Continued)

FOREIGN PATENT DOCUMENTS

JP 2005-346055 12/2005
JP 2006-227237 8/2006
(Continued)

OTHER PUBLICATIONS

International Search Report, dated Mar. 31, 2015, for International Application No. PCT/JP2014/006438.

*Primary Examiner* — Kenneth B Lee, Jr.
(74) *Attorney, Agent, or Firm* — Greenblum & Bernstein, P.L.C.

(57) ABSTRACT

An EL display apparatus includes pixels each including an EL element, a drive transistor, and a switch transistor, and further includes: a source driver circuit; a source signal line; a gate driver circuit; a first gate signal line; and a second gate signal line, wherein the gate driver circuit applies, to the first gate signal line, a first voltage or a second voltage, and the drive transistor is placed in a first state by the gate driver circuit applying the first voltage to the gate terminal of the drive transistor while the switch transistor is on, and is placed in a second state by the gate driver circuit applying the second voltage to the gate terminal of the drive transistor while the switch transistor is on.

8 Claims, 30 Drawing Sheets

(52) U.S. Cl.
CPC ..... *G09G 2310/0283* (2013.01); *G09G 2310/0286* (2013.01); *G09G 2310/0291* (2013.01); *G09G 2320/043* (2013.01); *G09G 2320/045* (2013.01)

(56) References Cited

U.S. PATENT DOCUMENTS

| | | | |
|---|---|---|---|
| 2010/0188384 | A1 | 7/2010 | Uchino et al. |
| 2016/0210898 | A1 | 7/2016 | Tsuge et al. |

FOREIGN PATENT DOCUMENTS

| | | |
|---|---|---|
| JP | 2007-310311 | 11/2007 |
| JP | 2011-145622 | 7/2011 |
| WO | 2015/033496 | 3/2015 |

| a | b | Selected |
|---|---|---|
| 0 | 0 | Voff |
| 0 | 1 | Vovd |
| 1 | 0 | Von |
| 1 | 1 | Von |

| i | i + 1 | Selected |
|---|---|---|
| 0 | 0 | Voff |
| 0 | 1 | Vovd |
| 1 | 0 | Von |
| 1 | 1 | Von |

EL DISPLAY APPARATUS

TECHNICAL FIELD

The present disclosure relates to an electroluminescent (EL) display apparatus, in particular to an EL display apparatus suitable for multi pixel display, such as a 4K2K panel, which includes an organic electroluminescent element (hereinafter, may be referred to as an EL or OLED element), a method for driving the EL display apparatus, a gate driver IC used in the EL display apparatus, and so forth.

BACKGROUND ART

In recent years, an electroluminescent (EL) display panel which includes pixels each including an EL element and arranged in a matrix, and an EL display apparatus which includes the EL display panel have already been on the market. An EL element emits light in response to a current flowing through a light emitting layer formed between an anode electrode and a cathode electrode.

A plurality of transistors are arranged in each pixel. Gate signal lines for controlling the transistors arranged in the pixels are formed on an EL display panel.

A transistor supplies a light emission current to the EL display apparatus. Various configurations have been proposed for circuits included in pixels. Furthermore, various configurations have been proposed for methods for supplying pixels with a voltage. For example, Patent Literature (PTL) 1 discloses a configuration in which a driver circuit supplies pixels with an anode voltage.

CITATION LIST

Patent Literature

[PTL 1] Japanese Unexamined Patent Application Publication No. 2007-310311

SUMMARY OF INVENTION

Technical Problem

The present disclosure provides a long-lived, high-quality EL display apparatus which prevents variations in the rise voltage (VT voltage) of a drive transistor.

Solution to Problem

An EL display apparatus according to an aspect of the present disclosure is an electroluminescent (EL) display apparatus including: a display screen in which pixels are disposed in a matrix, the pixels each including an EL element, a drive transistor which supplies the EL element with a current, and a switch transistor having a source terminal and a drain terminal one of which is connected to a gate terminal of the drive transistor; a source driver circuit which outputs a video signal to be applied to the pixels; a source signal line for transmitting the video signal output by the source driver circuit to the gate terminal of the drive transistor; a gate driver circuit which supplies the switch transistor with a control signal; a first gate signal line for supplying the other of the source terminal and the drain terminal of the switch transistor with a voltage from the gate driver circuit; and a second gate signal line for supplying the gate terminal of the switch transistor with the control signal from the gate driver circuit, wherein the gate driver circuit applies, to the second gate signal line, an on voltage which places the switch transistor in an operating state or an off voltage which places the switch transistor in a non-operating state, the gate driver circuit applies, to the first gate signal line, a first voltage or a second voltage, and the drive transistor is placed in a first state by the gate driver circuit applying the first voltage to the gate terminal of the drive transistor while the switch transistor is on, and is placed in a second state by the gate driver circuit applying the second voltage to the gate terminal of the drive transistor while the switch transistor is on.

Advantageous Effects of Invention

According to the present disclosure, a long-lived, high-quality EL display apparatus which prevents variations in the rise voltage (VT voltage) of a drive transistor can be provided.

Figure 1:
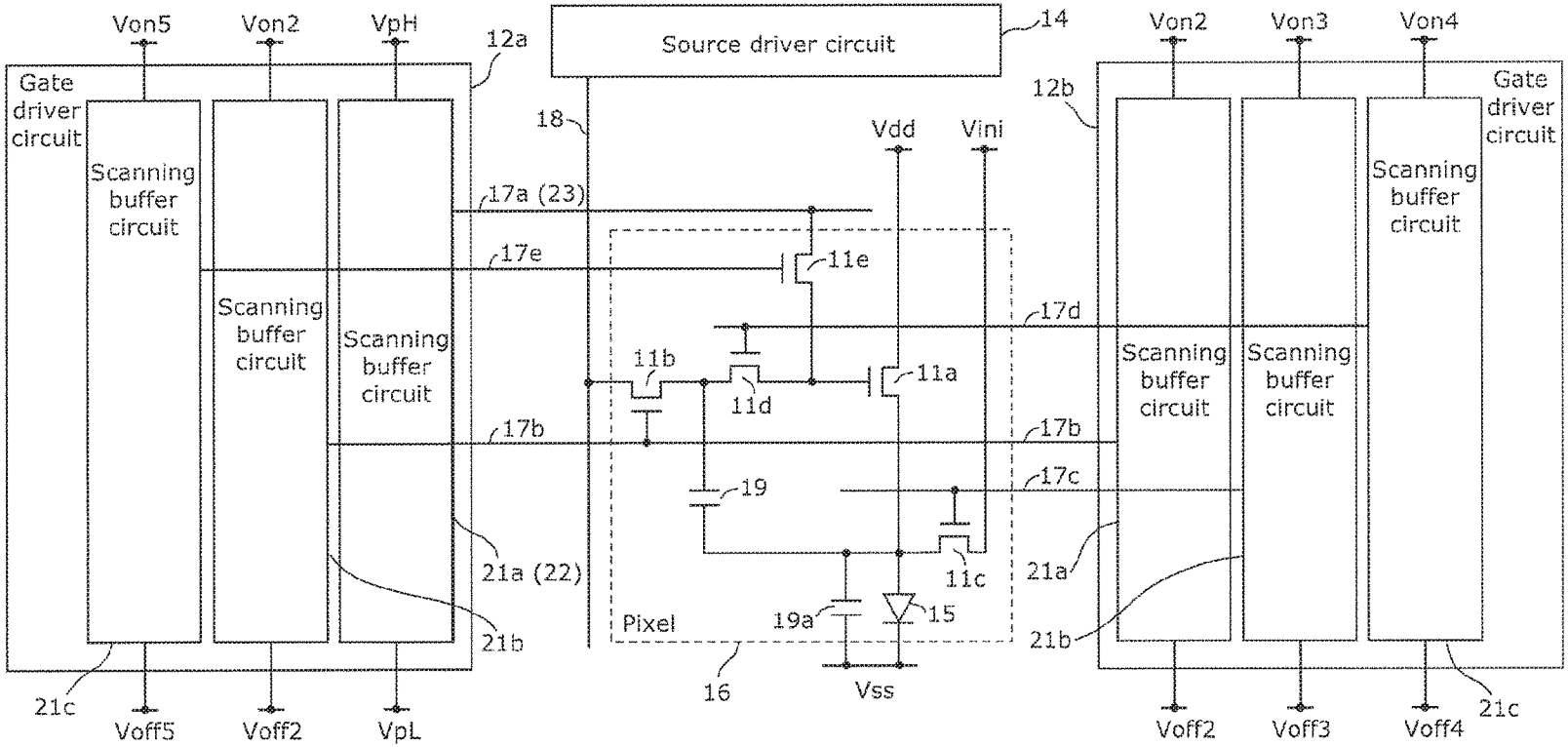
FIG. 1 is a configuration diagram of an EL display apparatus according to an embodiment.

DESCRIPTION OF EMBODIMENTS (Underlying Knowledge Forming Basis of the Present Invention)

The inventors have found that the EL display apparatus mentioned in the "Background Art" section has problems as below.

In a conventional EL display apparatus disclosed in PTL 1, an anode voltage is supplied from a driver circuit 105 to a drive transistor 3B. In contrast, a video signal is applied to the drive transistor 3B via a switch transistor 3A, and the drive transistor 3B supplies an EL element 3D with a light emission current, based on the video signal.

Depending on the video signal applied to the gate terminal and the magnitude of the anode voltage, a rise voltage (Vth voltage) of the drive transistor 3B changes (characteristics changes). Once the Vth voltage changes, even if the same video signal is applied to the drive transistor 3B, a current flowing through the EL element 3D changes. A change in the current causes a change in the brightness of the EL display apparatus or generates color unevenness.

In the EL display apparatus disclosed in PTL 1, the driver circuit 105 supplies the drive transistor 3B with an anode voltage. The voltage applied to a signal line 101 for supplying an anode voltage alternately changes between an off voltage and the anode voltage. Thus, a load is applied to the drive transistor 3B, and consequently the drive transistor 3B deteriorates, which is a problem.

In view of this, the inventors of the present disclosure have conceived an EL display apparatus which prevents a particular change of a drive transistor and a method for driving the EL display apparatus, and also conceived a versatile gate driver circuit which does not depend on the configuration of the EL display apparatus and a pixel circuit of the EL display apparatus.

The following describes in detail embodiments with reference to the drawings as appropriate. However, an unnecessarily detailed description may be omitted. For example, a detailed description of a matter already known well and a redundant description of substantially the same configuration may be omitted. This is intended to avoid making the following description unnecessarily redundant and to facilitate understanding of a person skilled in the art.

Note that the inventors provide the accompanying drawings and the following description in order that a person skilled in the art sufficiently understands the present disclosure, and do not intend to limit the subject matter of the claims by the drawings and description. The embodiments described below each show a preferable, specific example of the present invention. The numerical values, shapes, materials, constituent elements, the arrangement and connection of the constituent elements, steps, the processing order of the steps, and the like described in the following embodiments are examples, and thus are not intended to limit the present invention. Therefore, among the constituent elements in the following embodiments, constituent elements not recited in any of the independent claims defining the most generic part of the inventive concept of the present invention are described as arbitrary constituent elements.

Embodiment

Figure 2:
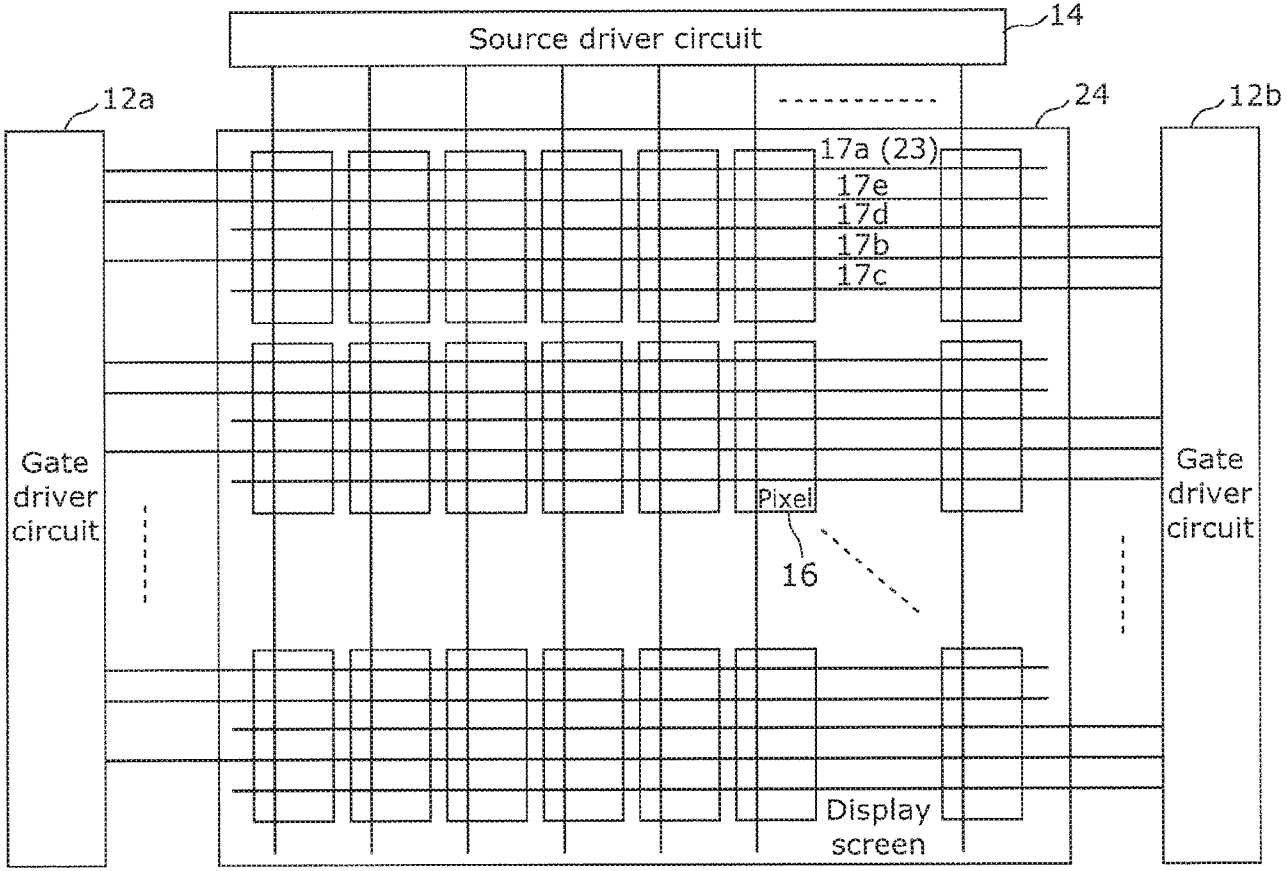
FIG. 2 is an explanatory diagram of the EL display apparatus according to the embodiment.
Figure 3:
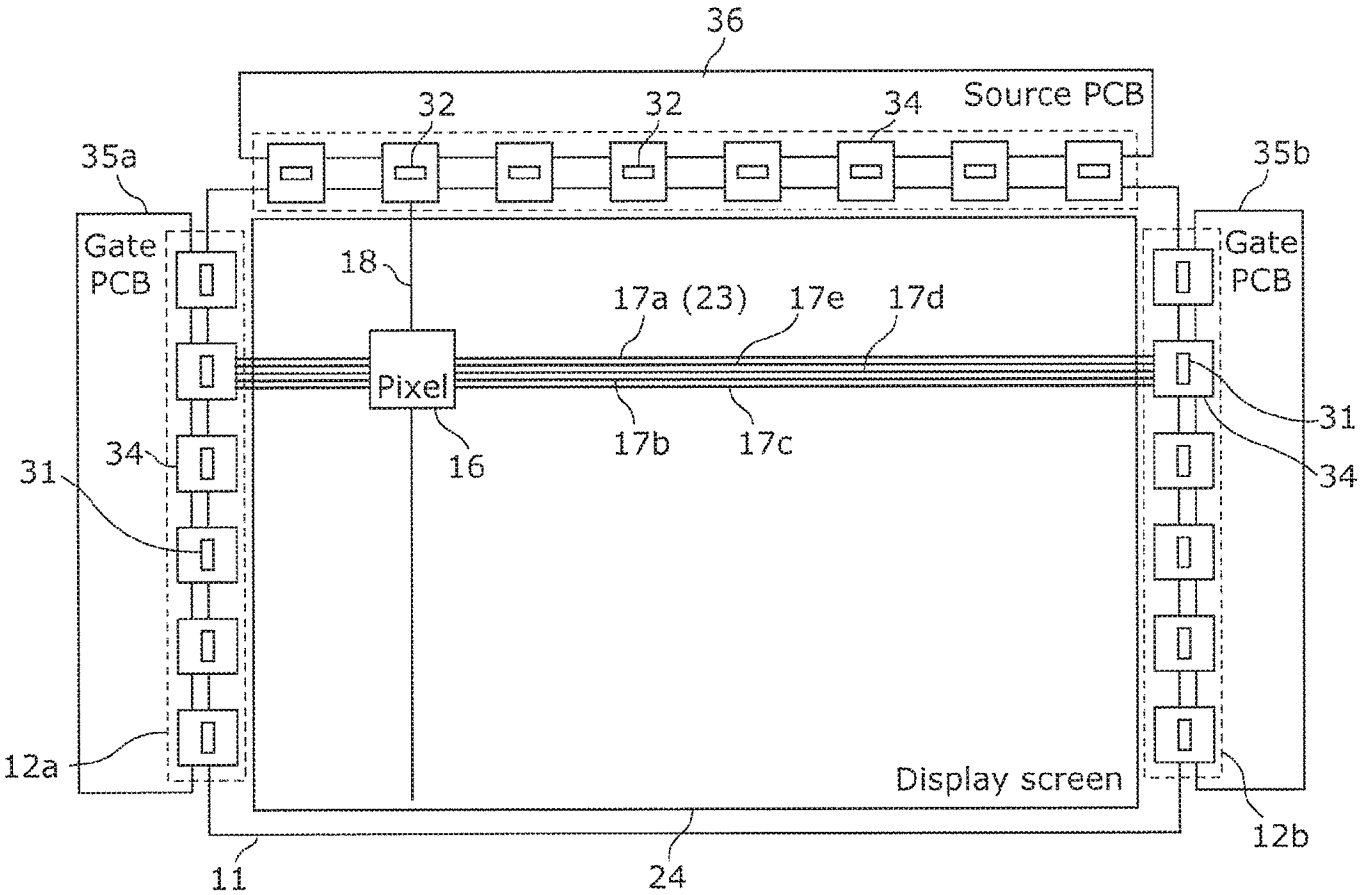
FIG. 3 is a configuration, diagram of the EL display apparatus according to the embodiment.

The following describes embodiments with reference to the drawings. FIGS. 1, 2, and 3 are configuration diagrams of an EL display apparatus according to the present embodiment.

As illustrated in FIGS. 1 to 3, an EL display apparatus according to the present embodiment includes: a display screen 24 in which pixels 16 are disposed in a matrix; gate signal lines 17*a* (23), and 17*b*, 17*c*, 17*d*, and 17*e* disposed for each of pixel rows of the display screen 24; source signal lines 18 disposed in correspondence with pixel columns of the display screen 24; a gate driver circuit (gate driver IC) 12*a* which is a peripheral circuit of the display screen 24, and drives the gate signal lines 17*a* (23), 17*e*, and 17*b*; a gate driver circuit (gate driver IC) 12*b* which drives the gate signal lines 17*d*, and 17*b* and 17*c*; a source driver circuit (source drivers IC) 14 which outputs video signals to the source signal lines 18; and a control circuit (not illustrated) which controls, for instance, the gate driver circuits 12*a* and 12*b*, and the source driver circuit 14.

The gate driver circuit 12*a* is connected to an end of the gate signal line 17*b* which is connected to a switch transistor 11*b* that applies a video signal to the pixel 16, and the gate driver circuit 12*b* is connected to the other end of the gate signal line 17*b*. In other words, the gate signal line 17*b* is a gate signal line for allowing either of the gate driver circuits 12*a* and 12*b* disposed on the sides of the display screen 24 of the EL display apparatus to drive (double-sided drive) the pixel 16.

As illustrated in FIGS. 2 and 3, the display screen 24 displays an image based on a video signal input from the outside to the EL display apparatus.

The gate signal lines 17*b*, 17*c*, 17*e*, and 17*d* are connected to at least one of the gate driver circuits 12*a* and 12*b*, and are connected to pixels 16 belonging to a pixel row. The gate signal lines 17*b*, 17*c*, 17*e*, and 17*d* have a function of transmitting a signal for controlling a timing for writing a signal voltage to the pixels 16 belonging to the pixel row, and a signal for controlling a timing for applying, to the pixels 16, various voltages such as an initializing voltage and a reference voltage.

In other words, the gate driver circuits 12*a* and 12*b* are connected to at least one of the gate signal lines 17*b*, 17*c*, 17*e*, and 17*d*, and have a function of controlling, by outputting a selection signal for selecting pixels 16 from the gate driver circuits 12*a* and 12*b* to the gate signal lines 17*b*, 17*c*, 17*e*, and 17*d*, conduction (on) and non-conduction (off) of switch transistors 11 (11*a*, 11*b*, 11*c*, 11*d*, and 11*e*) included in the selected pixels 16.

The gate signal line 17*b* is connected to the switch transistor 11*b*. The switch transistor 11*b* supplies the drive transistor 11*a* with a video signal applied to the source signal line 18. The switch transistor 11*b* needs to perform high-speed on/off operation (high slew rate operation). The gate signal line 17*b* achieves high slew rate operation, due to being driven by the two gate driver circuits 12*a* and 12*b* (double-sided driven).

The gate signal line 17*b* is driven by both the gate driver circuits 12*a* and 12*b*, thus eliminating, for instance, brightness gradient on left, right, and central portions of the display screen 24, and achieving favorable image display. Furthermore, even when the gate signal line 17*b* has great load capacity, the transistors can be driven favorably.

The gate signal line 17*a* (23) functions as a voltage signal line 23. The gate signal line 17*a* (23) is driven by the gate driver circuit 12*a*, but does not transmit or supply an on voltage (operating voltage) and an off voltage (non-operating voltage) for transistors. The gate signal line 17*a* (23) is a signal line which supplies voltages of plural types to one terminal of the switch transistor 11*e*. Hereinafter, the gate signal line 17*a* (23) may be referred to as the voltage signal line 23.

One of the voltages of plural types is a reverse bias voltage (Vnv). Another voltage is a reference voltage (Vref).

The reverse bias voltage (Vnv) is applied to the gate terminal of the drive transistor 11*a* during the entire or a part of a time period or at a time other than when the pixel 16 is in an image display state (a state where a light emission current is supplied to an EL element 15). The application of the reverse bias voltage (Vnv) reduces or prevents a change in the threshold voltage of the drive transistor.

Here, the reference voltage (Vref) corresponds to a first voltage of the present invention, and the reverse bias voltage (Vnv) corresponds to a second voltage of the present invention. A state where the reference voltage (Vref) is applied to the gate terminal of the drive transistor 11*a* via the gate signal line 17*a* (23) while the switch transistor 11*e* is on is referred to as a first state of the present invention, and a state where the reverse bias voltage (Vnv) is applied to the gate terminal of the drive transistor 11*a* via the gate signal line 17*a* (23) while the switch transistor 11*e* is on is referred to as the second state of the present invention.

Note that the following gives a description, assuming that the reverse bias voltage (Vnv) is applied to the gate terminal of the drive transistor 11*a*. However, the present embodiment is not limited to this. For example, the reverse bias voltage (Vnv) output by the gate driver circuit 12*a* may be applied to, for instance, the anode terminal of the EL element 15 or the gate terminal of another switch transistor.

The reverse bias voltage (Vnv) is lower than a video signal voltage if the drive transistor 11*a* is an n-channel transistor. For example, if the video signal voltage is 0 to 8 (V), the reverse bias voltage (Vnv) is the voltage of 0 (V) or less. Specifically, the reference voltage (Vref) which is the first voltage is a positive voltage, and the reverse bias voltage (Vnv) which is the second voltage is a negative voltage. The reverse bias voltage (Vnv) is a voltage lower than (Vmin−Vmax)/2, where Vmin denotes the minimum voltage of a video signal and Vmax denotes the maximum voltage thereof.

For example, when the minimum voltage of a video signal is Vmin=0 (V) and the maximum voltage thereof is Vmax=8 (V), the reverse bias voltage (Vnv) is a voltage lower than (0−8)/2=−4 (V). Furthermore, the lower limit of the reverse bias voltage (Vnv) is an off state voltage Voff5 of the switch transistor 11*e* connected to a scanning buffer circuit 21*c*. For example, if Voff5=−15 (V), the setting range of the reverse bias voltage (Vnv) is between −4 (V) and −15 (V), both inclusive.

In a pixel circuit of the pixel 16 in FIG. 1, if an on voltage is applied to the gate signal line 17*b*, the switch transistor 11*b* is turned on, and a video signal applied to the source signal line 18 is applied to the pixel 16.

Furthermore, the gate driver circuits 12*a* and 12*b* each include scanning buffer circuits 21*a*, 21*b*, and 21*c*. The gate driver circuits 12*a* and 12*b* are disposed on the left and right of the display screen 24, respectively.

In the configuration of the EL display apparatus illustrated in FIGS. 1 and 2, the gate driver circuits 12*a* and 12*b* disposed on the left and right of the display screen 24 are connected to the ends of the gate signal line 17*b*. The voltage signal line 23 and the gate signal lines 17*e* and 17*b* on one side are connected to the gate driver circuit 12*a* disposed on the left of the display screen 24. The gate signal lines 17*d*, 17*b*, and 17*c* on one side are connected to the gate driver circuit 12*b* disposed on the right side of the display screen 24.

The gate driver circuits 12*a* and 12*b* are mounted on chip on films (COF) 34, as illustrated in FIG. 3. In particular, the gate signal line 17*b* is preferably connected to the gate driver circuits 12*a* and 12*b* disposed on the sides of the display screens 24.

The source signal lines 18 are provided in correspondence with pixel columns of the display screen 24, or in other words, in correspondence with the number of pixel columns. The source signal lines 18 are connected to the source driver circuit 14, and to pixels 16 belonging to the pixel columns. Note that the gate signal lines 17 (the voltage signal lines 23) and the source signal lines 18 are disposed so as to be orthogonal to one another.

The source driver circuit 14 is connected with one end or both ends of each source signal line 18, and is a drive circuit which has functions of outputting video signals and supplying or applying the video signals to the pixels 16 via the source signal line 18. The source driver circuit 14 is mounted on COFs 34.

As illustrated in FIG. 3, source driver ICs 32 are mounted on the COFs 34 as the source driver circuit 14. Furthermore, gate driver ICs 31 are mounted on the COFs 34, as the gate driver circuits 12*a* and 12*b*.

Note that optical absorption coating may be applied to or an optical absorption material may be formed on the surfaces of the COFs 34, or optical absorption sheets may be attached to the surfaces of the COFs 34 so that the COFs 34 absorb light. Furthermore, radiator plates may be disposed or formed on the surfaces of the driver ICs mounted on the COFs 34 so as to dissipate heat from the driver circuits. Furthermore, radiation sheets and radiator plates may be disposed or formed on the back surfaces of the COFs 34, so as to dissipate heat generated by the driver circuits.

The COFs 34 on the source drivers IC 32 side are mounted on a source printed circuit board (PCB) 36 using anisotropic conductive film (ACF) resin. The COFs 34 on the gate driver IC 31 side are mounted on gate PCBs 35 using ACF resin.

A control circuit which is omitted from the illustration has a function of controlling the gate driver circuits 12*a* and 12*b* and the source driver circuit 14. The control circuit includes a memory (not illustrated) storing, for instance, correction data of the EL elements 15, and may be configured to read, for instance, the correction data written in the memory, correct a video signal input from the outside, based on the correction data, and output the corrected video signal to the source driver circuit 14.

The EL display apparatus illustrated in FIG. 1 may need several on voltages (Von) and also several off voltages (Voff). In addition to such voltages, an initial voltage (Vini), a reference voltage (Vref), and so on are necessary, according to the configuration of a pixel circuit.

In the gate driver circuits 12*a* and 12*b*, the scanning buffer circuits 21*a* to 21*c* which drive the voltage signal line 23 (the gate signal line 17*a*) and the gate signal lines 17*a* to 17*e* are formed. The scanning buffer circuits 21*a* to 21*c* include shift registers (not illustrated) and buffer circuits which drive, for instance, signal lines (not illustrated).

Note that the gate driver circuits 12*a* and 12*b* have a function of reversing the scanning direction. The gate driver circuits 12*a* and 12*b* set the scanning direction of internal shift register circuits to the reversed direction, thus reversing the scanning direction for scanning the display screen 24.

In the gate driver circuit 12*a*, the scanning buffer circuit 21*a* (22) outputs a VpH voltage or a VpL voltage to the voltage signal line 23. The VpH voltage is a reference voltage and the VpL voltage is a (Vref) voltage in the pixel circuit in FIG. 1. In the following, the scanning buffer circuit 21*a* of the gate driver circuit 12*a* in FIG. 1 is referred to as a voltage output circuit 22.

In the gate driver circuit 12*a*, the scanning buffer circuit 21*b* outputs a Von2 or Voff2 voltage to the gate signal line 17*b*. Von2 is a voltage which turns on the switch transistor 11*b* (causes the switch transistor 11*b* to operate), and Voff2 is a voltage which turns off the switch transistor 11*b* (causes the switch transistor 11*b*not to operate). The scanning buffer circuit 21*c* in the gate driver circuit 12*a*outputs a Von5 or Voff5 voltage to the gate signal line 17*e*. Von5 is a voltage which turns on the switch transistor 11*e* (causes the switch transistor 11*e* to operate), and Voff5 is a voltage which turns off the switch transistor 11*e* (causes the switch transistor 11*e* not to operate).

The gate signal line 17*e* is electrically connected to the gate terminal of the switch transistor 11*e*. By turning on the switch transistor 11*e* (causing the switch transistor 11*e* to operate), the scanning buffer circuit 21*a* of the gate driver circuit 12*a* (22) applies the VpL voltage or the VpH voltage to the gate terminal of the drive transistor 11*a*.

The gate signal line 17*b* is electrically connected to the gate terminal of the switch transistor 11*b*. By tuning on the switch transistor 11*b* (causing the switch transistor 11*b* to operate), a video signal applied by the scanning buffer circuit 21*b* to the source signal line 18 is applied to the pixel 16.

In the gate driver circuit 12*b*, the scanning buffer circuit 21*a* outputs the Von2 voltage or the Voff2 voltage to the gate signal line 17*b*. Note that the gate driver circuits 12*a* and 12*b* supply the gate signal line 17*b* with a selection signal. Accordingly, in the present embodiment, pixels 16 connected to the gate driver circuits 12*a* and 12*b* are double-sided driven.

In the gate driver circuit 12*b*, the scanning buffer circuit 21*b* outputs a Von3 or Voff3 voltage to the gate signal line 17*c*. Von3 is a voltage which turns on the switch transistor 11*c* (causes the switch transistor 11*c* to operate), and Voff3 is a voltage which turns off the switch transistor 11*c* (causes the switch transistor 11*c* not to operate).

In the gate driver circuit 12*b*, the scanning buffer circuit 21*c* outputs a Von4 or Voff4 voltage to the gate signal line 17*d*. Von4 is a voltage which turns on the switch transistor 11*d* (causes the switch transistor 11*d* to operate), and Voff4 is voltage which turns off the switch transistor 11*d* (causes the switch transistor 11*d* not to operate).

The gate signal line 17*c* is electrically connected to the gate terminal of the switch transistor 11*c*. By turning on the switch transistor 11*c* (causing the switch transistor 11*c* to operate), a Vini voltage is applied to the drain terminal of the drive transistor 11*a*.

The gate signal line 17*d* is electrically connected to the gate terminal of the switch transistor 11*d*. By turning on the switch transistor 11*d* (causing the switch transistor 11*d* to operate), a video signal from the switch transistor 11*b* is applied to the gate terminal of the drive transistor 11*a*.

The connection relation among the gate signal line 17*a* (the voltage signal line 23) and the gate signal lines 17*b* to 17*e*, the gate driver circuits 12*a* and 12*b*, and the switch transistors 11*b* to 11*e* is as follows.

The gate signal line 17*a* (the voltage signal line 23) and the gate signal lines 17*e* and 17*b* are connected to the single gate driver circuit 12*a*. The switch transistor 11*e* is connected to the gate signal line 17*e*. The switch transistor 11*e* has a function of applying the reference voltage Vref or the reverse bias voltage Vnv to the drive transistor 11*a*. Note that a low slew rate is sufficient to perform operation for turning on or off the switch transistor 11*e*, in order to apply the reference voltage Vref or the reverse bias voltage Vnv to the drive transistor 11*a*.

The gate signal lines 17*d* and 17*c* are connected to the single gate driver circuit 12*b*. The switch transistor 11*c* is connected to the gate signal line 17*c*. The switch transistor 11*c* has a function of applying the initial voltage Vini to the source terminal of the drive transistor 11*a*. Note that a low slew rate is sufficient to perform operation for turning on or off the switch transistor 11*c*, in order to apply the initial voltage Vini.

The switch transistor 11*d* is connected to the gate signal line 17*d*. The switch transistor 11*d* has a function of electrically connecting the source terminal of the switch transistor 11*b* and the gate terminal of the drive transistor 11*a*. A low slew rate is sufficient to perform this operation of the switch transistor 11*d*.

Figure 4:
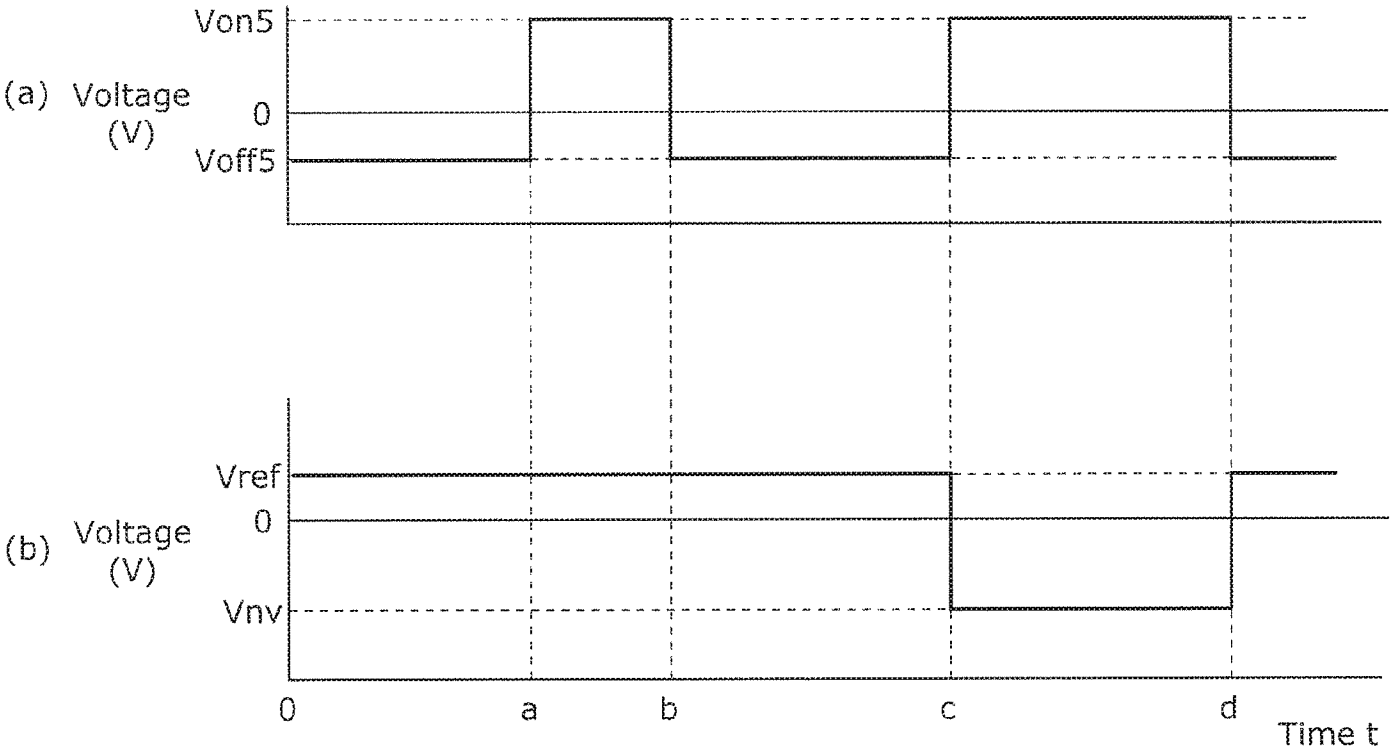
FIG. 4 is an explanatory diagram conceptually illustrating in (a) and (b) an operating state (voltage condition) of a switch transistor according to the embodiment.

Parts (a) and (b) of FIG. 4 are explanatory diagrams conceptually illustrating the operating state (voltage condition) of the switch transistor 11*e*. The scanning buffer circuit 21*c* included in the gate driver circuit 12*a* applies the Von5 voltage which is an operating voltage of the switch transistor 11*e* to the gate terminal of the switch transistor 11*e*, and thus the reference voltage (Vref) or the reverse bias voltage (Vnv) is applied to the gate terminal of the drive transistor 11*a*. If the scanning buffer circuit 21*c* applies the Voff5 voltage which is a non-operating voltage of the switch transistor 11*e* to the gate terminal of the switch transistor 11*e*, the switch transistor 11*e* is turned off and the voltage applied to the voltage signal line 23 is not applied to the drive transistor 11*a*.

Part (a) of FIG. 4 is a timing diagram illustrating a change in the voltage applied to the gate signal line 17*e*. In (a) of FIG. 4, Voff5 (off voltage) is applied to the gate signal line 17*e* between time 0 and time a and between time b and time c. Von5 (on voltage) is applied between time a and time b and between time c and time d.

Part (b) of FIG. 4 illustrates a change in the voltage applied to the voltage signal line 23. In (b) of FIG. 4, the reference voltage (Vref) is applied to the voltage signal line 23 between time 0 and time c. The reverse bias voltage (Vnv) is applied between time c and time d.

As illustrated in (a) and (b) of FIG. 4, the switch transistor 11*e* is turned on and the reference voltage Vref is applied to the gate terminal of the drive transistor 11*a* between time a and time b. Furthermore, between time c and time d, the switch transistor 11*e* is turned on, and the reverse bias voltage Vnv is applied to the gate terminal of the drive transistor 11*a*.

Here, the configuration of the pixel 16 illustrated in FIG. 1 is described in detail.

The drive transistor 11*a* is a drive element having a drain terminal electrically connected to an anode voltage Vdd which is a first power source line, and a source terminal electrically connected to the anode terminal of the EL element 15. The drive transistor 11*a* converts a voltage corresponding to a signal voltage applied between the gate terminal and the source terminal, into a drain current corresponding to the signal voltage. Then, the drive transistor 11*a* supplies the EL element 15 with the drain current as a signal current. The drive transistor 11*a* includes an N-type thin-film transistor (N-type TFT), for example.

The EL element 15 has an anode terminal electrically connected to the source terminal of the drive transistor 11*a*, and a cathode terminal electrically connected to a cathode voltage Vss which is a second power source line. The EL element 15 emits light based on the magnitude of a signal current while the drive transistor 11*a* is passing the signal current. The magnitude of the signal current is determined by the switch transistor 11*b* applying, to the pixel 16, a video signal applied to the source signal line 18.

The switch transistor 11*d* has a gate terminal electrically connected to the gate signal line 17*d*, a source terminal electrically connected to the gate terminal of the drive transistor 11*a*, and a drain terminal connected to the source terminal of the switch transistor 11*b*. If the on voltage is applied to the gate signal line 17*d*, the switch transistor 11*d* is turned on, and the source terminal of the switch transistor 11*b* and the gate terminal of the drive transistor 11*a* are electrically connected.

The switch transistor 11*b* has a gate terminal electrically connected to the gate signal line 17*b*, a source terminal electrically connected to the drain terminal of the switch transistor 11*d*, and a drain terminal electrically connected to the source signal line 18. The switch transistor 11*b* applies, to the pixel 16, a video signal applied to the source signal line 18.

The switch transistor 11*c* has a gate terminal electrically connected to the gate signal line 17*c*, a source terminal electrically connected to the source terminal of the drive transistor 11*a*, and a drain terminal to which the initial voltage (initializing voltage, Vini) is applied or supplied. The switch transistor 11*c* has a function of determining a timing when the initial voltage (Vini) is to be applied to the source terminal of the drive transistor 11*a* and one electrode of a capacitor 19.

The switch transistor 11*e* has a gate terminal electrically connected to the gate signal line 17*e*, a source terminal electrically connected to the gate terminal of the drive transistor 11*a*, and a drain terminal connected to the voltage signal line 23. The switch transistor 11*e* has a function of determining a timing when the reference voltage (Vref) or the reverse bias voltage (Vnv) is to be applied to the gate terminal of the drive transistor 11*a*.

The capacitor 19 has a first terminal connected to the source terminal of the switch transistor 11*b* and a second terminal electrically connected to the anode terminal of the EL element 15. Note that the first terminal of the capacitor 19 may be connected to the source terminal of the switch transistor 11*d*, and the second terminal thereof may be electrically connected to the anode terminal of the EL element 15. Note that a second capacitor 19*a* may be disposed (formed) in parallel with the EL element 15.

Here, electrical connection means a state where a path of voltage and a path of current are formed or can be formed. For example, a drive transistor and a transistor A can be said as being electrically connected even if a transistor B is disposed between the drive transistor and the transistor A. Note that in the present disclosure, "connect" may be used to mean "electrically connect."

In the pixel 16 of FIG. 1, when the switch transistor 11*d* is on and the switch transistors 11*e*, 11*b*, and 11*c* are off, a current is supplied via the anode voltage Vdd to the EL element 15, thus placing the EL element 15 in a light emitting state (light emission period). A drive current Id (a current flowing between the drain and the source) is supplied to the EL element 15 via the anode voltage Vdd through the drive transistor 11*a*.

By turning off the switch transistors 11*e* and 11*d*, the gate terminal potential of the drive transistor 11*a* can be set to an off potential or a potential near the off potential. A current which flows into the EL element 15 is interrupted, and light emission of the EL element 15 stops (non-light emission). To supply the EL element 15 with a current, the switch transistors 11*e* and 11*d* may be turned on again. On and off of the switch transistors 11*e* and 11*d* are controlled, thus achieving intermittent display.

The capacitor 19 is formed or disposed so as to overlap (overlie) one of the source signal line 18 and the gate signal lines 17*a* to 17*e*. In this case, the flexibility of the layout improves, thus securing a larger space between elements and achieving an increase in yields.

Regarding the EL element 15 in the pixel 16 illustrated in FIG. 1, the anode electrode or the cathode electrode of the EL element 15 is disposed or formed on one of the source signal line 18, the voltage signal line 23, and the gate signal line 17*a* to 17*e*, and thus the electric fields from, for instance, the source signal line 18 and the gate signal lines 17*a* to 17*e* are shielded by the anode electrode or the cathode electrode, thus reducing noise to image display.

The source signal line 18 and the gate signal lines 17*a* to 17*e* are insulated by an insulating film or an insulating film (planarization film) made of an acrylics material. A pixel electrode is formed on the insulating film.

Note that a configuration in which a pixel electrode overlies at least a portion of the gate signal lines 17*a* to 17*e* and others is referred to as a high aperture (HA) structure. Unnecessary interference light, for instance, decreases and a favorable light emission state can be achieved.

As a pixel electrode of the pixel 16, a transparent electrode which includes tin-doped indium oxide (ITO), IGZO (indium, gallium, zinc, and oxygen), indium zinc oxide (IZO), a transparent amorphous oxide semiconductor (TAOS), or the like can be used.

Note that channels between the drive transistor 11*a* and the switch transistors 11*b* to 11*e* are bidirectional, and thus the names, that is, the source terminal and the drain terminal, are given in order to facilitate the description, and thus the source terminal and the drain terminal may be switched. Further, the source terminal and the drain terminal may be referred to as a first terminal and a second terminal.

A description is given assuming that transistors which include the drive transistor 11*a* and the switch transistors 11*b* to 11*e* are thin-film transistors (TFTs), but the transistors are not limited to TFTs. Each of the drive transistor 11*a* and the switch transistors 11*b* to 11*e* may of course be a field-effect transistor (FET), a metal oxide semiconductor (MOS) FET, a MOS transistor, and a bipolar transistor. These are also thin-film transistors.

Such a transistor is not limited to a thin film element, and may be a transistor formed on a silicon wafer. An example is a transistor formed on and peeled off a silicon wafer, and transferred onto a glass substrate. Another example is a display panel which is a glass substrate on which a transistor chip made from a silicon wafer is mounted by bonding.

Note that it is preferable to employ a lightly doped drain (LDD) structure for the drive transistor 11*a* and the switch transistors 11*b* to 11*e*, regardless of N-type and P-type transistors.

The drive transistor 11*a* and the switch transistors 11*b* to 11*e* may be formed using any of: high-temperature polycrystalline silicon (HTPS); low-temperature polycrystalline silicon (LTPS); continuous grain silicon (CGS); transparent amorphous oxide semiconductors (TAOS), IZO; amorphous silicon (AS); and infrared rapid thermal annealing (RTA).

In FIG. 1, all the transistors included in a pixel are N-type transistors. In the EL display apparatus according to the present invention, the transistors included in a pixel are not limited only to N-type transistors. A pixel may include only N-type transistors or only P-type transistors. Furthermore, a pixel may include both N-type and P-type transistors. Furthermore, the drive transistor 11*a* may include both P-type and N-type transistors.

The switch transistors 11*b* to 11*e* are not limited to transistors, and for example, may be analog switches which include both P-type and N-type transistors.

It is preferable to employ a top gate structure for the drive transistor 11*a* and the switch transistors 11*b* to 11*e*. That is because employing the top gate structure decreases parasitic capacitance, and allows a gate electrode pattern of the top gate to serve as a light shielding layer which blocks light emitted from the EL element 15, thus reducing malfunction of a transistor and off leak current.

It is preferable to form the drive transistor 11*a* and the switch transistors 11*b* to 11*e* using LTPS. LTPS allows producing N-type and P-type transistors having a top gate structure and less parasitic capacitance, and allows use of a process in which a copper or copper alloy line is employed. Note that it is preferable to employ a three layered structure of Ti—Cu—Ti for a copper line.

It is preferable to perform a process in which a copper line or a copper alloy line can be employed as the line material of the gate signal line 17*a* (the voltage signal line 23), the gate signal lines 17*b* to 17*e*, and the source signal line 18. In this manner, the line resistance of a signal line can be reduced, and a larger EL line panel can be achieved.

It is preferable to employ a three-layered structure of Mo—Cu—Mo for lines such as the gate signal lines 17*a* to 17*e* and the source signal line 18, if the transistors 11*a* to 11*e* are TAOS.

The pixel 16 in FIG. 1 preferably has a relationship satisfying the following: anode voltage Vdd>reference voltage Vref>cathode voltage Vss>initial voltage Vini. Specific examples are as follows: the anode voltage Vdd=10 to 18 (V), the reference voltage Vref=1.5 to 3 (V), the cathode voltage Vss=0.5 to 2.5 (V), and the initial voltage Vini=0 to −3 (V). Note that the same applies to the pixel circuit in FIG. 29 described below.

As illustrated in FIG. 1, it is preferable that the gate signal line 17*b* is connected to both the gate driver circuits 12*a* and 12*b*. This is because of the following reasons.

The gate signal line 17*b* is connected to the switch transistor 11*b*. It is because the switch transistor 11*b* is a transistor which writes a video signal to the pixel 16, and needs to perform high-speed on/off operation (high slew rate operation). The gate signal line 17*b* can achieve high slew rate operation by being driven by both the gate driver circuits 12*a* and 12*b*.

Note that as an example, the gate driver circuit 12*a* is disposed on the left of the display screen 24, and the gate driver circuit 12*b* is disposed on the right side of the display screen 24.

The gate signal line 17*b* is driven by both the gate driver circuits 12*a* and 12*b*, and thus eliminating, for instance, brightness gradient on left, right, and central portions of the display screen 24, and achieving favorable image display. Furthermore, even if the gate signal line 17*b* has great load capacity, the transistors can be driven favorably.

The source driver circuit (IC) 14A includes a delay circuit (multi-delay circuit) (not illustrated). The delay circuit has a function of varying or adjusting the output timing of a video signal, in synchronization with a clock CLK applied to the source driver circuit (IC) 14 or based on a clock frequency. The delay circuit can set, for each block, a delay time of the source signal lines connected to the source driver circuit (IC) 14. For example, if the single source driver IC (circuit) 14 has 720 source signal lines 18 for each of RGB and the number of blocks for which a delay circuit 204 sets a delay time is 36, the delay circuit 204 can set a value of delay time for each unit that is a set of 60 source signal lines which are obtained by 720×3/36, depending on whether a delay is to be made for the block.

Note that the delay time may be referred to as a multi-delay time. The delay time may be set or adjusted by controlling a timing of sending out a video signal from the source driver circuit (IC) 14. The source driver circuit (IC) 14 controls the delay time based on the timing control by an internal digital-to-analog (DA) circuit (DA converter circuit). Furthermore, the source driver circuit (IC) 14 controls the delay time based on the clock timing control by the DA circuit. In addition, the source driver circuit (IC) 14 controls the delay time based on the timing control by the gate driver circuits 12*a* and 12*b*.

For example, the settings are as follows: for a first block, delay, the delay time is 20 ns; for a second block, delay, the delay time is 30 ns; for a third block, not delay, the delay time is 0 ns; . . . ; for a 60th block, delay, the delay time is 10 ns. Note that setting a delay time may be based on either of an absolute delay time and a relative delay time (for adjacent block units), but it is preferable to employ relative delay time setting. Relative delay time setting allows setting increasing a delay time and decreasing a delay time.

In the above embodiment, the delay circuit can set delay times for the source signal lines connected to the single source driver circuit (IC) 14 on a block-by-block basis, yet the EL display apparatus according to the present disclosure is not limited to such a configuration. It is needless to say that a configuration in which a delay time can be set for each terminal (each channel) may be adopted. For example, if the single source driver circuit (IC) 14 has 720 output terminals for each of RGB, a configuration in which 720×3 delay times can be set is adopted. Furthermore, a configuration in which "delay" or "not delay" can be set for each of 720×3 channels is adopted.

Furthermore, a configuration in which a delay time can be set or controlled for each pixel row is adopted. For a pixel row of the display screen 24 close to a position where the display screen 24 is connected to the source driver circuit (IC) 14 (an edge of the display screen), a delay time may be short, whereas a delay time needs to be long for a pixel row in the central portion of the display screen 24. It is because the source signal lines 18 have a time constant. Accordingly, timings (delay times) for the output of video signals from the source driver circuit (IC) 14 can be set in correspondence with the positions of pixel rows. If the above configurations are employed, a delay time is a total of a delay time for a pixel row and a delay time for a block or a channel.

In the present embodiment, the state in which the reference voltage (Vref) is applied to the gate signal line 17*b* differs for an end near the gate driver circuits 12*a* and 12*b* and for an end far therefrom. The farther away an end of the gate signal line 17*b* is from the gate driver circuits 12*a* and 12*b*, the more the applied reference voltage (Vref) is rounded due to the time constant of the gate signal line 17*a*. Thus, the delay circuit controls timings of applying a video signal to the pixels 16, in correspondence with the positions of the pixels 16 relative to the gate driver circuits 12*a* and 12*b*, The following describes operation of the pixel 16 with reference to FIGS. 2 and 5 to 15. FIGS. 5 to 15 are explanatory diagrams of a circuit for showing operation of the pixel 16.

First, settings configured when the EL display apparatus according to the present embodiment starts are described. When the EL display apparatus is powered on, a state of data latched in shift register circuits (not illustrated) in the scanning buffer circuits 21*a* to 21*c* in the gate driver circuits 12*a* and 12*b* is undetermined. The on voltage, the off voltage, or the like is applied to the gate signal line 17*a* (the voltage signal line 23) and the gate signal lines 17*b* to 17*e*, depending on a state of data stored in respective shift register circuits.

Thus, if the on voltage or the off voltage, for instance, is applied to the gate signal line 17*a* (the voltage signal line 23) and the gate signal lines 17*b* to 17*e*, while data stored in the shift register circuits is undetermined, a current flows from the drive transistor 11*a* to the EL elements 15, which may cause an unnecessary image display state. Furthermore, an over-current may flow into a power circuit connected to an anode and a cathode, which may break the power circuit.

Figure 5:
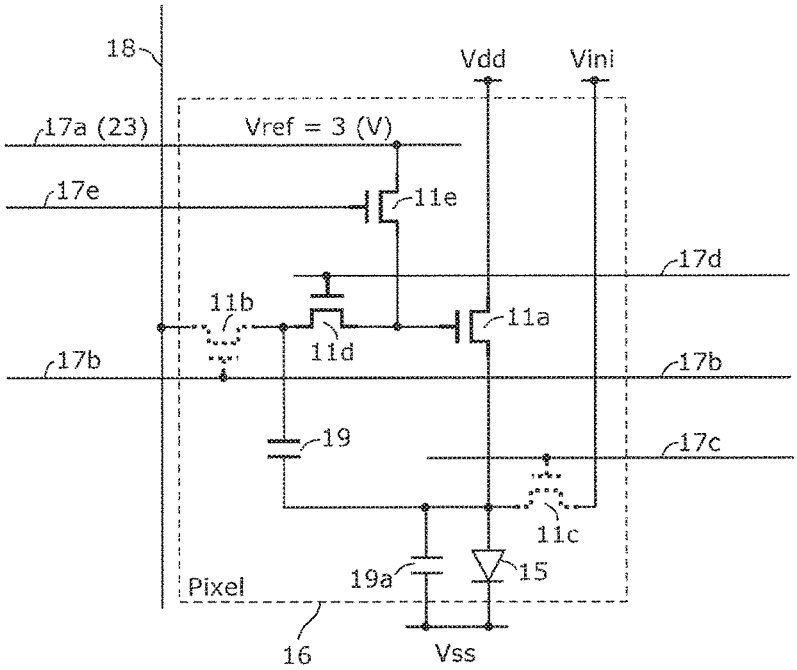
FIG. 5 is an explanatory diagram of a circuit, for illustrating operation of a pixel according to the embodiment.
Figure 6:
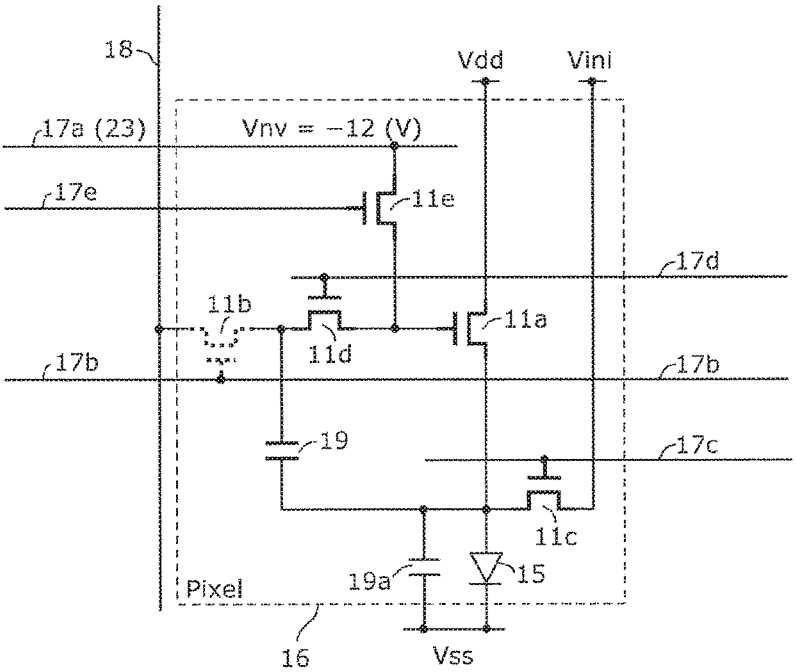
FIG. 6 is an explanatory diagram of the circuit, for illustrating operation of the pixel according to the embodiment.

In the present embodiment, in order to address the aforementioned problem, the sequence illustrated in FIG. 5 or FIG. 6 or the sequences illustrated in both of FIGS. 5 and 6 is/are performed at the time when the EL display apparatus starts up (boots up) or at the time when the EL display apparatus shuts down (is powered down).

FIG. 5 is a circuit diagram illustrating the state of the pixel 16 when the switch transistors 11*e*, 11*d*, and 11*c* are on, and the switch transistor 11*b* is off. The reference voltage (Vref (3 (V) as an example in FIG. 5)) is applied to the voltage signal line 23. The initial voltage Vini is −2 (V) as an example.

FIG. 5 illustrates a state of the pixel 16 when initialization operation is performed. The capacitor 19 is connected between the gate terminal and the source terminal of the drive transistor 11*a*, the reference voltage Vref is applied to the gate terminal of the drive transistor 11*a*, and the initial voltage Vini is applied to the source terminal of the drive transistor 11*a*. Next, tuning off the switch transistor 11*c* places the drive transistor 11*a* in an offset cancellation state. Accordingly, the capacitor 19 between the gate terminal and the source terminal of the drive transistor 11*a* stores a rise voltage (Vth voltage), which prevents current supply from the drive transistor 11*a* to the EL element 15.

The initialization operation and the offset cancellation operation described above are each performed on all the gate signal lines 17 of the display screen 24 collectively. In the present embodiment, the gate driver circuits 12 each include an enabling control terminal, and according to a logic signal supplied to the enabling control terminal, apply the on voltage or the off voltage to the gate signal lines 17 and the voltage signal line 23 collectively, independently of data in the shift register circuit.

In FIG. 5, the reference voltage of 3 (V) is applied to the voltage signal lines 23 of the display screen 24 collectively, the on voltage is applied to the gate signal lines 17*e*, 17*d*, and 17*c* of the display screen 24 collectively, and the off voltage is applied to the gate signal lines 17*b* of the display screen 24 collectively.

Next, while maintaining the state where the reference voltage of 3 (V) is applied to the voltage signal lines 23 of the display screen 24 collectively, the state where the on voltage is applied to the gate signal lines 17*e* and 17*d* of the display screen 24 collectively, and the state where the off voltage is applied to the gate signal lines 17*b* of the display screen 24 collectively, the off voltage is applied to the gate signal lines 17*c* of the display screen 24 collectively, thus turning off the switch transistors 11*c*.

The setting or operation configured or performed as described above cancels the offset of the drive transistors 11*a* of the display screen 24.

Next or simultaneously with or prior to the start of the above-described operation, data in the shift register circuit of each gate driver circuit 12 is subjected to clear operation. Clear operation is basically to create a state in which the reference voltage Vref is applied to the voltage signal line 23 and a state in which the off voltage is applied to the gate signal lines 17*a* to 17*e*.

Next, the anode voltage Vdd and the cathode voltage Vss are supplied to the display screen 24. Note that it is preferable to supply the cathode voltage Vss, and thereafter supply the anode voltage Vss.

FIG. 6 illustrates operation for dealing with a defect when the EL display apparatus starts (boots up) or shuts down (is terminated).

In FIG. 6, the switch transistors 11*e* and 11*d* are turned on, and the switch transistors 11*b* and 11*c* are turned off. The reverse bias voltage (Vnv (in FIG. 6, −12 (V) as an example)) is applied to the voltage signal line 23.

The state illustrated in FIG. 6 shows operation of applying the reverse bias voltage to the drive transistor 11*a*. Applying the reverse bias voltage Vnv to the gate terminal of the drive transistor 11*a* prevents a current flow from the drive transistor 11*a* into the EL element 15.

The above operation of applying the reverse bias voltage (Vnv) is performed on the gate signal lines 17*a* (the voltage signal lines 23) and the gate signal lines 17*b* to 17*e* of the display screen 2 collectively. In the present embodiment, the gate driver circuits 12*a* and 12*b* each include the enabling control terminal, and according to a logic signal supplied to the enabling control terminal, apply the on voltage or the off voltage to the gate signal lines 17*a* (the voltage signal lines 23) and the gate signal lines 17*b* to 17*e* collectively, independently of data in the shift register circuit.

In FIG. 6, for example, the reverse bias voltage Vnv of −12 (V) is applied to the gate signal lines 17*a* (the voltage signal lines 23) of the display screen 24 collectively, the on voltage is applied to the gate signal lines 17*e* and 17*d* of the display screen 24 collectively, and the off voltage is applied to the gate signal lines 17*b* and 17*c* of the display screen 24 collectively. The above setting or operation as described above turns off the drive transistors 11*a* of the display screen 24.

Continuously or simultaneously with or prior to the start of the above-described operation, data in the shift register circuits of the gate driver circuits 12*a* and 12*b* are subjected to clear operation. Clear operation is basically to create a state in which the reverse bias voltage Vnv is applied to the gate signal line 17*a* (the voltage signal line 23) and a state in which the off voltage is applied to the gate signal lines 17*b* to 17*e*.

Next, the anode voltage Vdd and the cathode voltage Vss are supplied to the display screen 24. Note that it is preferable to supply the cathode voltage Vss to the display screen 24, and thereafter supply the anode voltage Vss.

Figure 7:
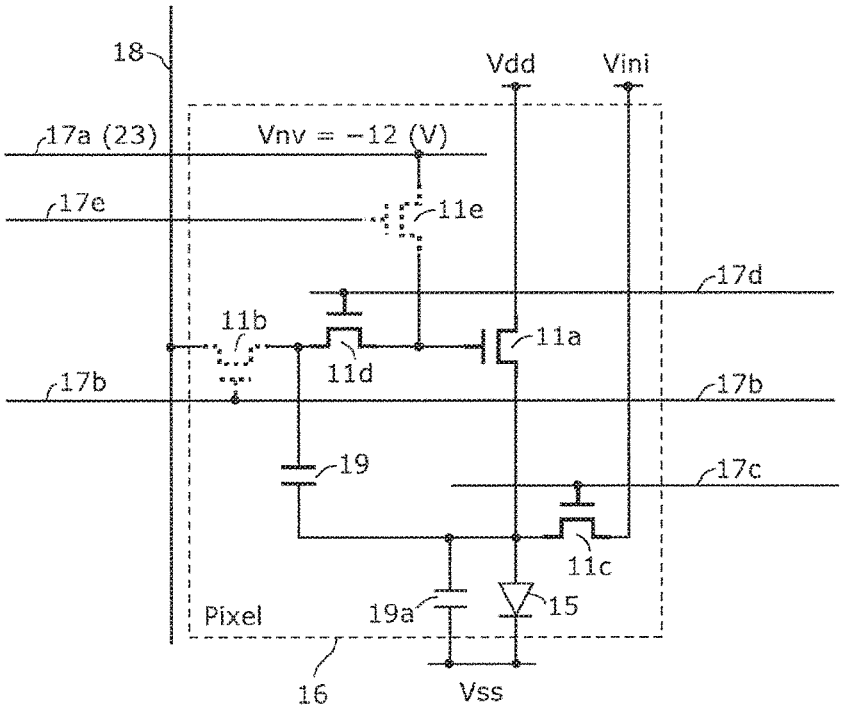
FIG. 7 is an explanatory diagram of the circuit, for illustrating operation of the pixel according to the embodiment.

The following describes reverse bias driving, with reference to FIG. 7.

Reverse bias driving is performed during a period when the drive transistor 11*a* is not supplying a light emission current to the EL element 15. For example, reverse bias driving is performed during the "display off period" of the EL display apparatus. Examples of "display off period" include a period during which the power is off, a black insertion display period, a power supply starting period, and a power supply termination period.

The starting voltage of the drive transistor 11*a* for starting to pass a current is shifted by continues operation of the drive transistor 11*a* or passage of time. The starting voltage which causes a current to start flowing is referred to as a Vth voltage. Furthermore, a change in the starting voltage is referred to as Vth shift. Vth shift includes both a voltage increase and a voltage decrease. Whether a Vth shift is a voltage increase or a voltage decrease and how much change is made by the Vth shift differ depending on the structure, the characteristic, and the polarity of the drive transistor 11*a*.

The Vth shift of the drive transistor 11*a* is avoided by applying the reverse bias voltage Vnv to the gate terminal of the drive transistor 11*a*.

If the drive transistor 11*a* is an n-channel transistor, the reverse bias voltage (Vnv) is a voltage lower than a video signal voltage. For example, if the video signal voltage is 0 to 8 (V), the reverse bias voltage (Vnv) is a voltage of 0 (V) or less. When the minimum voltage of a video signal is Vmin and the maximum voltage thereof is Vmax, the reverse bias voltage (Vnv) is a voltage lower than (Vmin−Vmax)/2.

For example, when the minimum voltage of a video signal is Vmin=0 (V) and the maximum voltage thereof is Vmax=8 (V), the reverse bias voltage (Vnv) is a voltage lower than (0−8)/2=−4 (V). The lower limit is the off voltage Voff5 of the switch transistor 11*e* of the scanning buffer circuit 21*c*. For example, if Voff5=−15 (V), the setting range of the reverse bias voltage (Vnv) is between −4 (V) and −15 (V), both inclusive.

Note that depending on the pixel configuration, the video signal voltage may be a negative voltage. If the video signal has a negative voltage, the reverse bias voltage (Vnv) is a positive voltage. For example, when the maximum voltage of the video signal is Vmax=0 (V) and the minimum voltage thereof is Vmin=−8 (V), the reverse bias voltage (Vnv) is a voltage higher than (8−0)/2=4 (V). The upper limit is the on voltage Von5 of the switch transistor 11*e* of the scanning buffer circuit 21*c*. For example, if Von5=15 (V), the setting range of the reverse bias voltage (Vnv) is between 4 (V) and 15 (V), both inclusive.

Although the above is an example in which the drive transistor 11*a* is an n-channel transistor, the same applies to the case where the drive transistor is a p-channel (p-polarity) transistor. Thus, also in the case where the drive transistor 11*a* is a p-channel transistor, the polarity and magnitude of the reverse bias voltage (Vnv) may be set based on the polarity and magnitude of a video signal.

In other words, as an aspect, the reverse bias voltage (Vnv) has a polarity opposite to that of a video signal (a voltage in the opposite direction), and is basically within a range between the maximum or minimum voltage of a video signal and the on or off voltage of the gate driver circuits 12*a* and 12*b*. The range is preferably between an average of the maximum voltage and the minimum voltage of a video signal and the on or off voltage of the gate driver circuits 12*a* and 12*b*.

Note that although the present embodiment gives a description assuming that the reverse bias voltage (Vnv) is applied to the gate terminal of the drive transistor 11*a*, the present embodiment is not limited to this. For example, the reverse bias voltage (Vnv) may be applied to a terminal other than the anode terminal of the EL element 15, the gate terminals of the switch transistors 11*b* to 11*e*, and the gate terminal of the drive transistor 11*a*.

In FIG. 7, the switch transistors 11*e*, 11*c*, and 11*d* are turned on, and the switch transistor 11*b* is turned off. The reverse bias voltage (Vnv (in FIG. 6, −12 (V) as an example)) is applied to the gate signal line 17*a* (the voltage signal line 23).

FIG. 7 illustrates the state where operation of applying the reverse bias voltage to the drive transistor 11*a* is being performed.

The application of the reverse bias voltage Vnv to the gate terminal of the drive transistor 11*a* prevents a current flow from the drive transistor 11*a* into the EL element 15.

The above operation of applying the reverse bias voltage (Vnv) is performed on the gate signal lines 17*a* (the voltage signal lines 23) and the gate signal lines 17*b* to 17*e* of the display screen 24 collectively. In the present embodiment, the gate driver circuits 12*a* and 12*b* each include the enabling control terminal, and according to a logic signal supplied to the enabling control terminal, apply the on voltage or the off voltage to the gate signal lines 17*a* (the voltage signal lines 23) and the gate signal lines 17*b* to 17*e* collectively, independently of data in the shift register circuit. Note that enabling control is to compulsorily apply the on voltage or the off voltage to the output terminal of a shift register circuit (not illustrated), independently of the on or off state of data in the shift register.

In FIG. 7, the reverse bias voltage Vnv of −12 (V) is applied to the gate signal lines 17*a* (the voltage signal lines 23) of the display screen 24 collectively, the on voltage is applied to the gate signal lines 17*e*, 17*c*, and 17*d* of the display screen 24 collectively, and the off voltage is applied to the gate signal lines 17*b* of the display screen 24 collectively. The above setting or operation turns off the drive transistors 11*a* of the display screen 24. Note that in FIG. 7, even if the switch transistor 11*c* is set to off, the reverse bias voltage (Vnv) can be applied to the drive transistor 11*a*.

Figure 8:
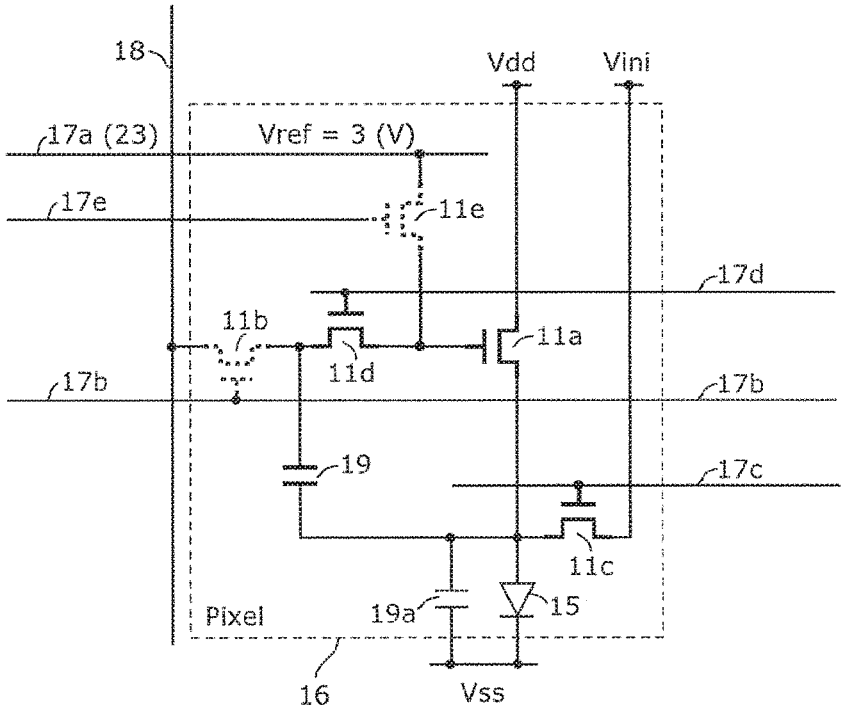
FIG. 8 is an explanatory diagram of the circuit, for illustrating operation of the pixel according to the embodiment.

To make a transition from the state where the reverse bias voltage (Vnv) is applied as illustrated in FIG. 7 to a state where normal display operation such as offset cancellation is performed, transition operation illustrated in FIG. 8 is performed.

The following describes transition operation performed when a transition is made from the state where the reverse bias voltage (Vnv) is applied to a state where normal display operation is performed, with reference to FIG. 8.

Differences between the pixel 16 illustrated in FIG. 7 and the pixel 16 illustrated in FIG. 8 are that in the pixel 16 illustrated in FIG. 8, the reference voltage (Vref=3 (V)) is applied to the gate signal line 17*a* (the voltage signal line 23), and the switch transistor 11*e* is off. Note that since the switch transistor 11*e* is off, the reverse bias voltage (Vnv=−12 (V)) may be applied to the gate signal line 17*a* (the voltage signal line 23). To make a transition to the initialized state illustrated in FIG. 9, it is preferable that the reference voltage (Vref=3 (V)) has been applied to the gate signal line 17*a* (the voltage signal line 23).

Figure 9:
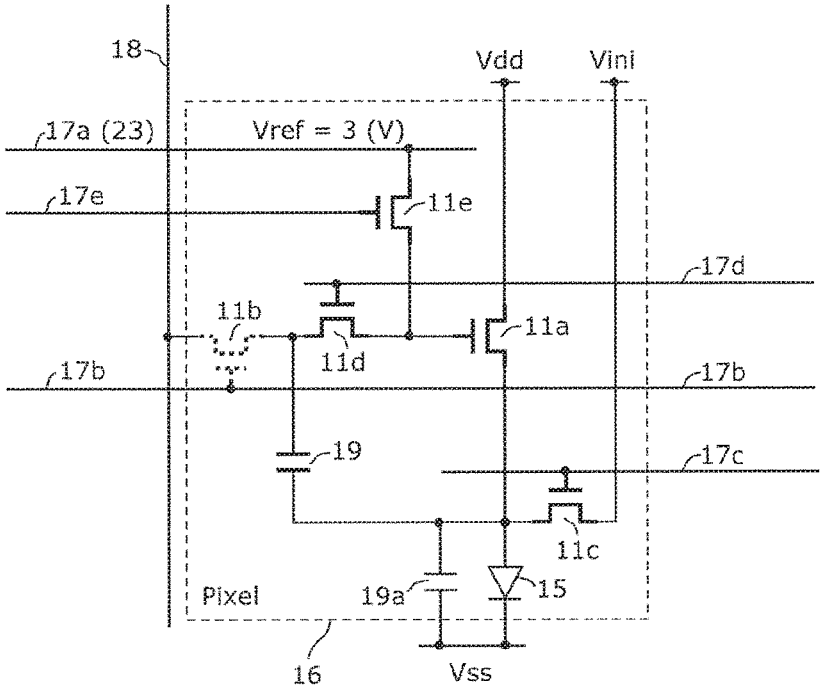
FIG. 9 is an explanatory diagram of the circuit, for illustrating operation of the pixel according to the embodiment.

The following describes operation of the pixel 16 during the offset cancellation preparation period (initialization period) with reference to FIG. 9.

During the offset cancellation preparation period (initialization period), the reference voltage (Vref=3 (V)) is applied to the gate signal line 17*a* (the voltage signal line 23), and the switch transistor 11*d* is turned on. The switch transistor 11*c* is turned on, and the initial voltage Vini is applied to the anode terminal of the EL element 15. Accordingly, the source potential of the drive transistor 11*a* becomes the initial voltage Vini which is sufficiently lower than the reference voltage Vref.

Here, the initial voltage Vini is set so that a gate-source voltage Vgs of the drive transistor 11*a* is higher than an offset cancellation voltage Vth of the drive transistor 11*a*. In this manner, a gate potential Vg of the drive transistor 11*a* is initialized to the reference voltage Vref, and a source potential Vs of the drive transistor 11*a* is initialized to the low voltage Vini, thus completing preparation for offset cancellation operation.

Figure 10:
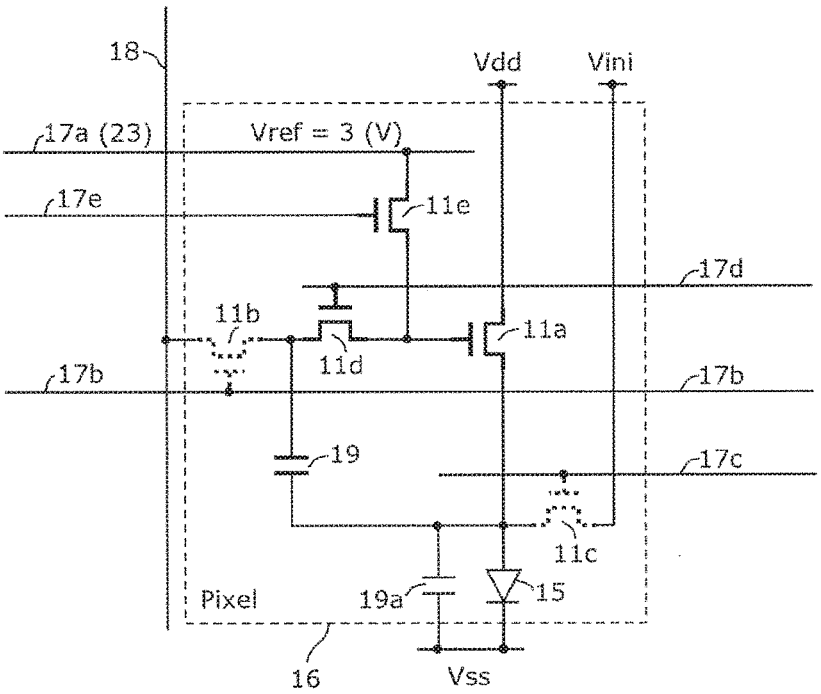
FIG. 10 is an explanatory diagram of the circuit, for illustrating operation of the pixel according to the embodiment.
Figure 11:
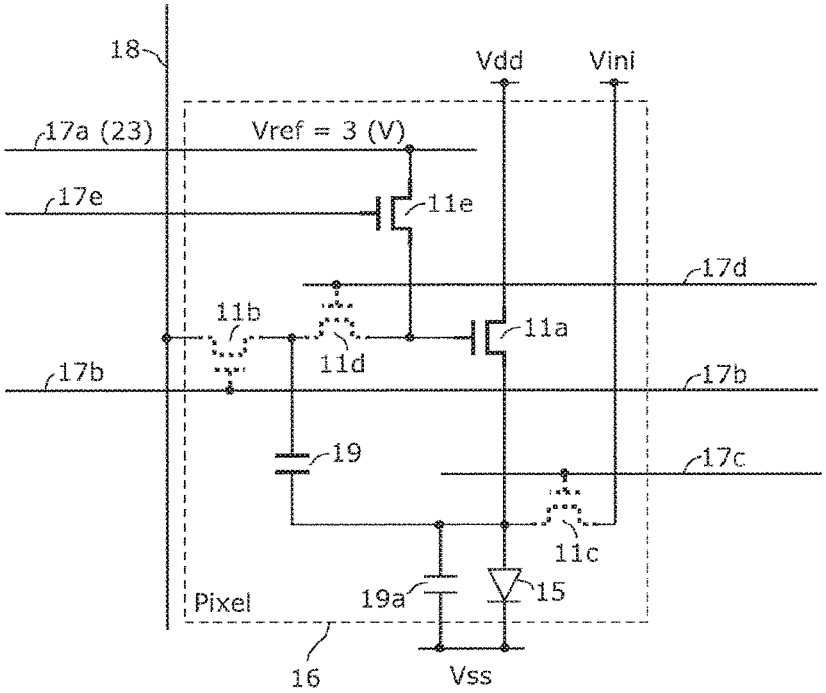
FIG. 11 is an explanatory diagram of the circuit, for illustrating operation of the pixel according to the embodiment.

The following describes operation during an offset cancellation (threshold correction) period for the pixel 16, with reference to FIGS. 10 and 11.

As illustrated in FIG. 10, the switch transistor 11*c* is turned off while the switch transistors 11*e*, 11*c*, and 11*d* are turned on and the switch transistor 11*b* is turned off.

The anode voltage Vdd is applied to the drain terminal of the drive transistor 11*a*, and the source potential Vs of the drive transistor 11*a* starts increasing. In a short time, the gate-source voltage Vgs of the drive transistor 11*a* reaches the offset cancellation voltage Vth of the drive transistor 11*a*, and a voltage corresponding to the offset cancellation voltage Vth is written to the capacitor 19.

Here, for convenience, a period during which a voltage corresponding to the offset cancellation voltage Vth is written to the capacitor 19 is referred to as an offset cancellation period.

Note that a value of the cathode voltage Vss applied to the cathode electrode is set to a value which places the EL element 15 in the cutoff state so that during this offset cancellation period, most of the current flows on the capacitor 19 side and does not flow on the EL element 15 side. Thus, the value is set such that Vss>Vini. For example, if Vss is +2 (V), Vini is set to −2 (V).

Figure 12:
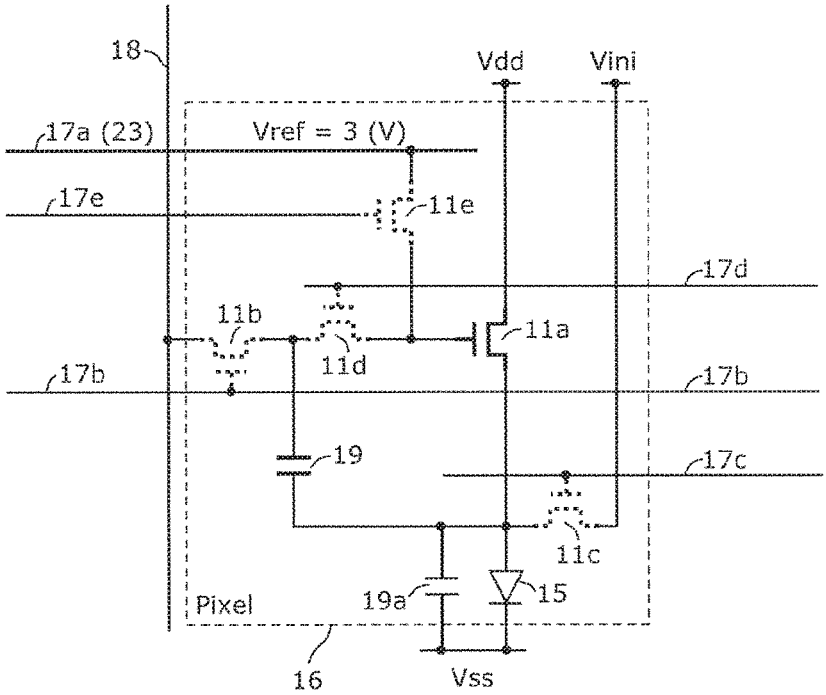
FIG. 12 is an explanatory diagram of the circuit, for illustrating operation of the pixel according to the embodiment.

Next, the switch transistor 11*d* is turned off as illustrated in FIG. 11. After that, the switch transistor 11*e* is turned off as illustrated in FIG. 12. At this time, although the gate of the drive transistor 11*a* is placed in a high impedance state, the gate-source voltage Vgs is equal to the offset cancellation voltage Vth of the drive transistor 11*a*, and thus the drive transistor 11*a* is in the cutoff state. Accordingly, the drain-source current Id does not flow.

Figure 13:
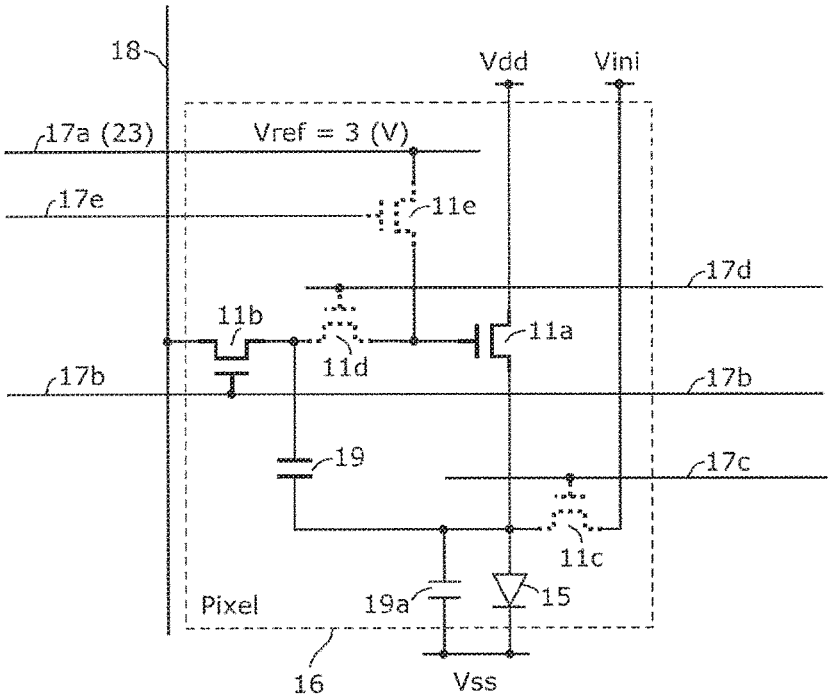
FIG. 13 is an explanatory diagram of the circuit, for illustrating operation of the pixel according to the embodiment.
Figure 14:
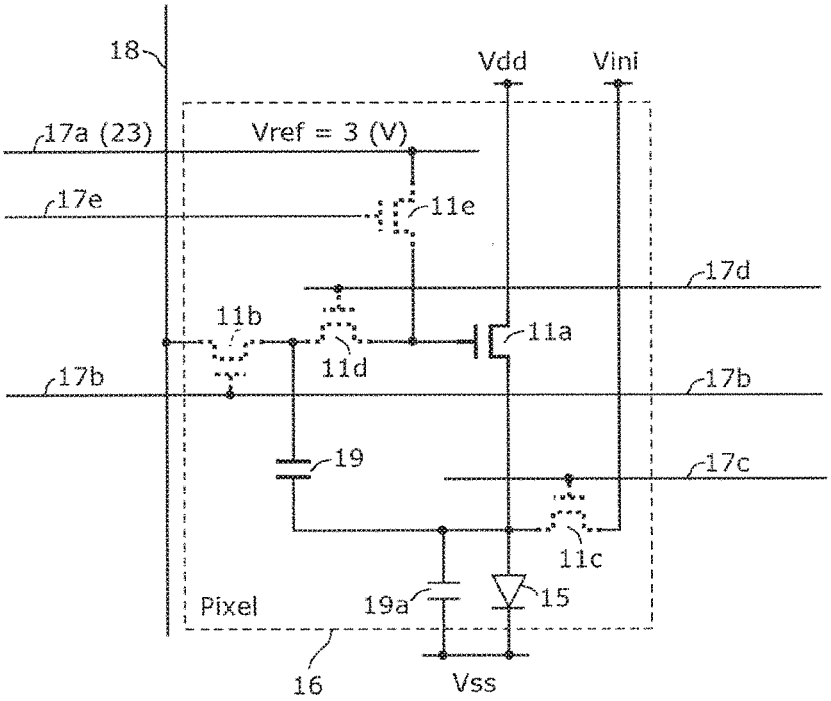
FIG. 14 is an explanatory diagram of the circuit, for illustrating operation of the pixel according to the embodiment.

The following describes a writing period for the pixel 16 (writing a video signal to a pixel), with reference to FIGS. 13 and 14.

As illustrated in FIG. 13, the source driver circuit 14 applies a video signal voltage Vsig to the source signal line 18. By applying a selection voltage to the gate signal line 17*b*, the switch transistor 11*b* is placed in the conductive state, and the video signal voltage Vsig is applied to one terminal of the capacitor 19.

Accordingly, the video signal voltage Vsig is divided by a capacity Cs of the capacitor 19 and a capacity Cel of the capacitor 19*a*, and the divided video signal voltage Vsig is applied between the gate terminal and the source terminal of the drive transistor 11*a*. A capacity Cel of the EL element is smaller than the capacity Cs of the capacitor 19, and thus much of the video signal voltage Vsig is applied between the gate terminal and the source terminal of the drive transistor 11*a*.

After that, as illustrated in FIG. 14, the off voltage is applied to the gate signal line 17*b*, and the switch transistor 11*b* is turned off.

Figure 15:
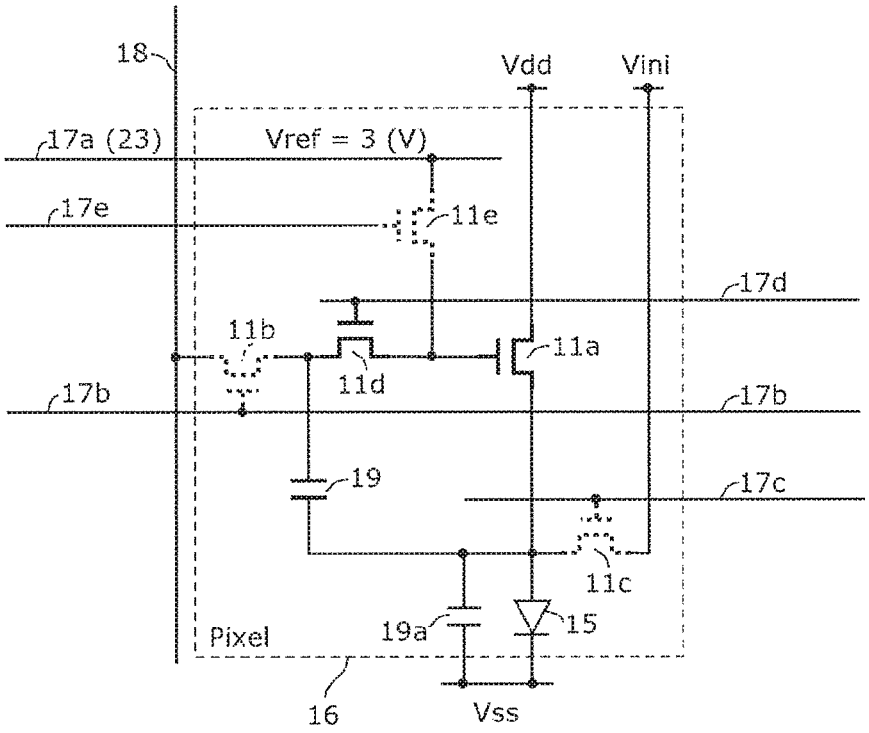
FIG. 15 is an explanatory diagram of the circuit, for illustrating operation of the pixel according to the embodiment.

The following describes a light emission period of the pixel 16 with reference to FIG. 15.

As illustrated in FIG. 15, a voltage stored in the capacitor 19 is applied to the gate terminal of the drive transistor 11*a*, in response to the switch transistor 11*d* being turned on. The anode voltage Vdd is applied to the drain terminal of the drive transistor 11*a*, and thus the current Id begins to flow. This causes the EL element 15 to emit light in proportion to the current Id.

By the above operation, offset cancellation is performed on the drive transistors 11*a* in the pixels 16, thus controlling whether to cause the pixels 16 to emit light.

Figures 16, 17:
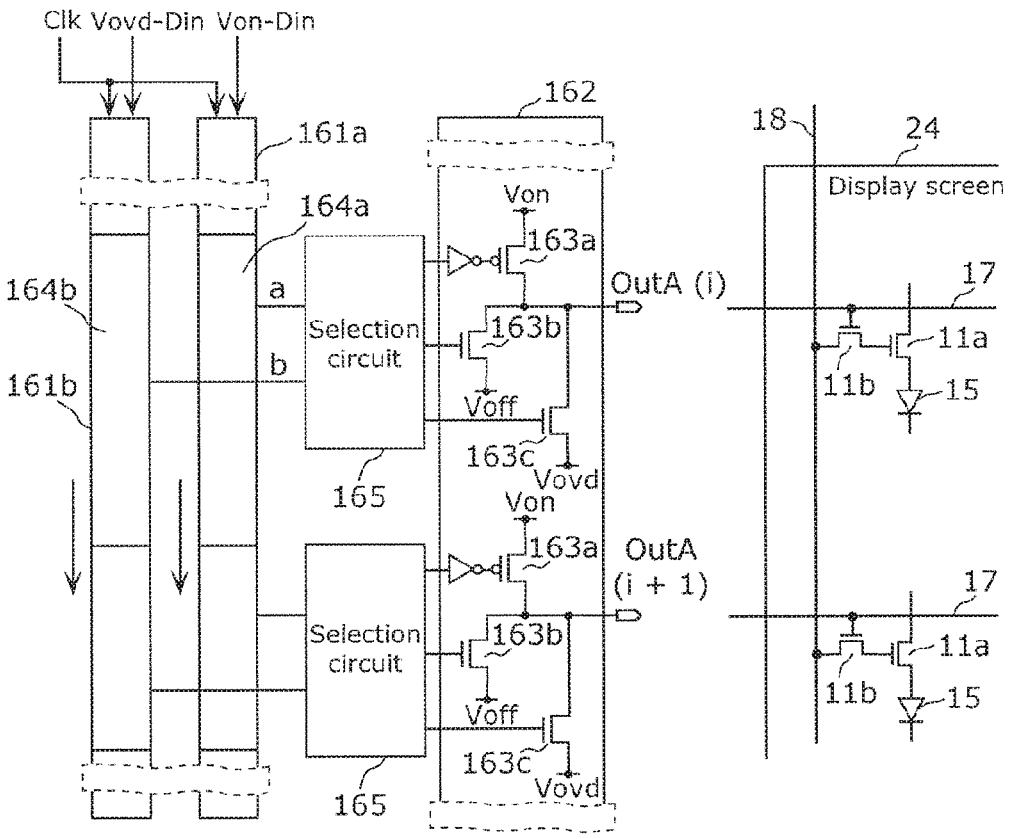
FIG. 16 is a configuration diagram of a scanning buffer circuit according to the embodiment.
FIG. 17 illustrates voltages selected by a selection circuit in a gate driver circuit according to the embodiment.

The following describes the scanning buffer circuit 21*a* and the voltage output circuit 22. In fact, the scanning buffer circuit 21*a* and the voltage output circuit 22 have substantially the same circuit configuration, and thus hereafter each referred to as the scanning buffer circuit 21*a* (22) in order to simplify the description. FIG. 16 is a configuration diagram of the scanning buffer circuit 21*a* (22) of the EL display apparatus according to the present embodiment. Note that the scanning buffer circuits 21*b* and 21*c* have the same configuration as that of the scanning buffer circuit 21*a*, and thus a description is omitted.

When the scanning buffer circuit 21*a* (22) is used as a scanning buffer circuit, the scanning buffer circuit 21*a* (22) outputs the on voltage or the off voltage to the gate signal lines 17*a* to 17*e*, and when the scanning buffer circuit 21*a* (22) is used as a voltage output circuit, the scanning buffer circuit 21*a* (22) outputs (applies) two predetermined voltages (for example, the reference voltage (Vref) and the reverse bias voltage (Vnv)) to the gate signal lines 17*a* to 17*e*.

As illustrated in FIG. 16, the scanning buffer circuit 21*a* (22) includes shift register circuits (scanning circuits) 161*a* and 161*b* which include D flip-flops, and a voltage output circuit (buffer circuit) 162.

When the scanning buffer circuit 21*a* is used as an output means which outputs the on voltage or the off voltage, the scanning buffer circuit 21*a* outputs the on voltage which is applied as Von5 to the gate signal line 17*e*. Furthermore, the scanning buffer circuit 21*a* outputs the off voltage which is applied as Voff 5 to the gate signal line 17*e*.

When the scanning buffer circuit 21*b* is used as an output means which outputs the on voltage or the off voltage, the scanning buffer circuit 21*b* outputs the on voltage which is applied as Von2 to the gate signal line 17*b*. Furthermore, the scanning buffer circuit 21*b* outputs the off voltage which is applied as Voff2 to the gate signal line 17*b*.

When the scanning buffer circuit 21*a* is used as the voltage output circuit 22, the scanning buffer circuit 21*a* outputs a first voltage which is applied as VpH to the voltage signal line 23. Furthermore, the scanning buffer circuit 21*a* outputs a second voltage which is applied as VpL to the voltage signal line 23.

When the scanning buffer circuit 21*a* outputs the on voltage or the off voltage to the gate signal lines 17*a* to 17*e*, and is used as the voltage output circuit 22, the scanning buffer circuit 21*a* applies two predetermined voltages (for example, the reference voltage (Vref), and the reverse bias voltage (Vnv)) to the gate signal lines 17*a* to 17*e*.

Figures 18, 19:
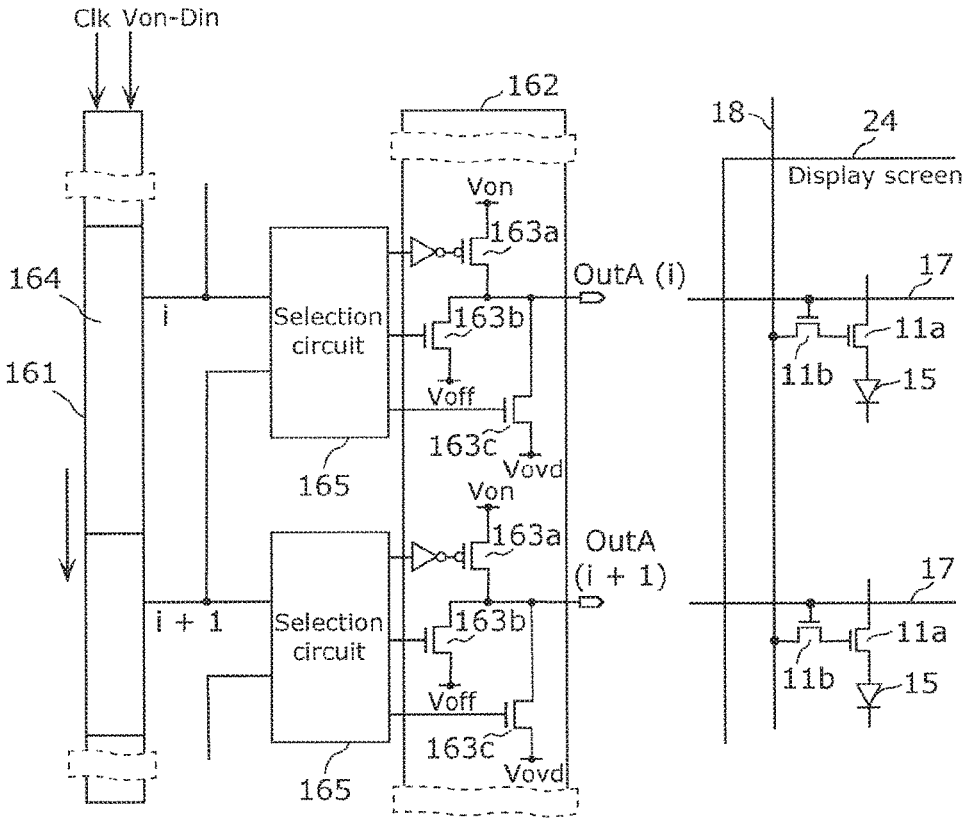
FIG. 18 is a configuration diagram of the gate driver circuit according to the embodiment.
FIG. 19 illustrates voltages selected by the selection circuit in the gate driver circuit according to the embodiment.

As described above, the voltages (for example, VpH and VpL) applied to two terminals included in the scanning buffer circuit 21 are applied to the gate signal lines 17*a* to 17*e*. Note that the above present embodiment has given a description assuming that the scanning buffer circuit 21*a* (22) has two terminals, but the present embodiment is not limited to this, and the scanning buffer circuit 21*a* (22) may have three terminals. For the example in which three or more terminals are included, three-gate-voltage driving described with reference to FIGS. 16 and 18 is shown as an example.

Specifically, the same clock Clk is input to the shift register circuits 161*a* and 161*b*, as illustrated in FIG. 16. Data Vovd-Din which indicates the position of a pixel row to which an overload voltage Vovd is applied is input to the shift register circuit 161*a*. Data Von-Din which indicates the position of a pixel row to which the on voltage Von is applied is input to the shift register circuit 161*b*.

When the output of a D flip-flop 164*a* included in the shift register circuit 161*a* is a, and the output of a D flip-flop 164*b* included in the shift register circuit 161*b* is b, a selection circuit 165 performs operation illustrated in FIG. 17. FIG. 17 illustrates voltages selected by the selection circuit 165.

Note that the selection circuit 165 is a logic circuit included in a 2-3 decoder. Three outputs are changed by the inputs a and b, and on and off of transistors 163*a*, 163*b*, and 163*c* connected to the outputs are controlled. By controlling on and off of the transistors 163*a*, 163*b*, and 163*c*, one voltage is selected from among the Von voltage, the Voff voltage, and the Vovd voltage, and the selected voltage is output from an OutA terminal to the gate signal line 17 (23). As illustrated in FIG. 17, voltages are selected in correspondence with the inputs a and b.

As an example, when the input a=0 (low level) and the input b=0 (low level), the off voltage Voff is output from the OutA terminal. If the input a=0 (low level) and the input b=1 (high level), the off voltage Vovd is output from the OutA terminal. If the input a=1 (high level) and the input b=0 (low level), the on voltage Von is output from the OutA terminal, If the input a=1 (high level) and the input b=1 (high level), the on voltage Von is output from the OutA terminal.

Note that the configuration illustrated in FIG. 16 allows three-gate-voltage driving to be performed without using a delay unit. Furthermore, the Vovd voltage can be set in synchronization with a Clock Clk for each 1H (one pixel-row selection period). Based on Vovd-Din and data input to a Von-Din terminal, the Von voltage and the Voff voltage can be set for each 1H (one-clock basis). For example, the Von voltage can be set for nH (n is an integer of one or more) with ease.

FIG. 18 illustrates the scanning buffer circuit 21*a* (22) which includes a single shift register circuit 161. As illustrated in FIG. 18, the clock Clk is input to the shift register circuit 161. The data Von-Din which indicates the position of a pixel row to which the on voltage Vovd is to be applied is input to the shift register circuit 161.

The selection circuit 165 performs operation illustrated in FIG. 19 when one output from a D flip-flop 164 included in the shift register circuit 161 is i, and the next output of the D flip-flop 164 is (i+1). FIG. 19 illustrates second examples of voltages selected by the selection circuit 165. As illustrated in FIG. 19, voltages are selected for inputs i and (i+1).

Note that the selection circuits 165 are logic circuits each of which includes a 2-3 decoder and inputs of which are i and (i+1). The selection circuits 165 change three outputs based on the inputs i and (i+1), and control on and off of the transistors 163*a*, 163*b*, and 163*c* connected to the outputs. Controlling on and off of the transistors 163*a*, 163*b*, and 163*c* selects one of the Von voltage, the Voff voltage, and the Vovd voltage, and the selected voltage is output to the gate signal line 17 (23) from the OutA terminal.

As an example, when the input i=0 (low level) and the input (i+1)=0 (low level), the off voltage Voff is output from the OutA terminals. When the input i=0 (low level) and the input (i+1)=1 (high level), the off voltage Vovd is output from the OutA terminals. When the input i=1 (high level) and the input (i+1)=0 (low level), the on voltage Von is output from the OutA terminals. When the input i=1 (high level) and the input (i+1)=1 (high level), the on voltage Von is output from the OutA terminals.

Note that the configuration illustrated in FIG. 18 allows three-gate-voltage driving to be performed without using a delay unit. The Vovd voltage can be set in synchronization with the clock Clk for each 1H (one pixel-row selection period). Based on data input to a Von-Din terminal, the Von voltage and the Voff voltage can be set for each 1H (1-clock basis). For example, the Von voltage can be readily set for nH (n is an integer of one or more). The configuration illustrated in FIG. 18 achieves three-gate-voltage driving using the single shift register circuit 161.

Here, two-gate-voltage driving and three-gate-voltage driving are described.

Figure 20:
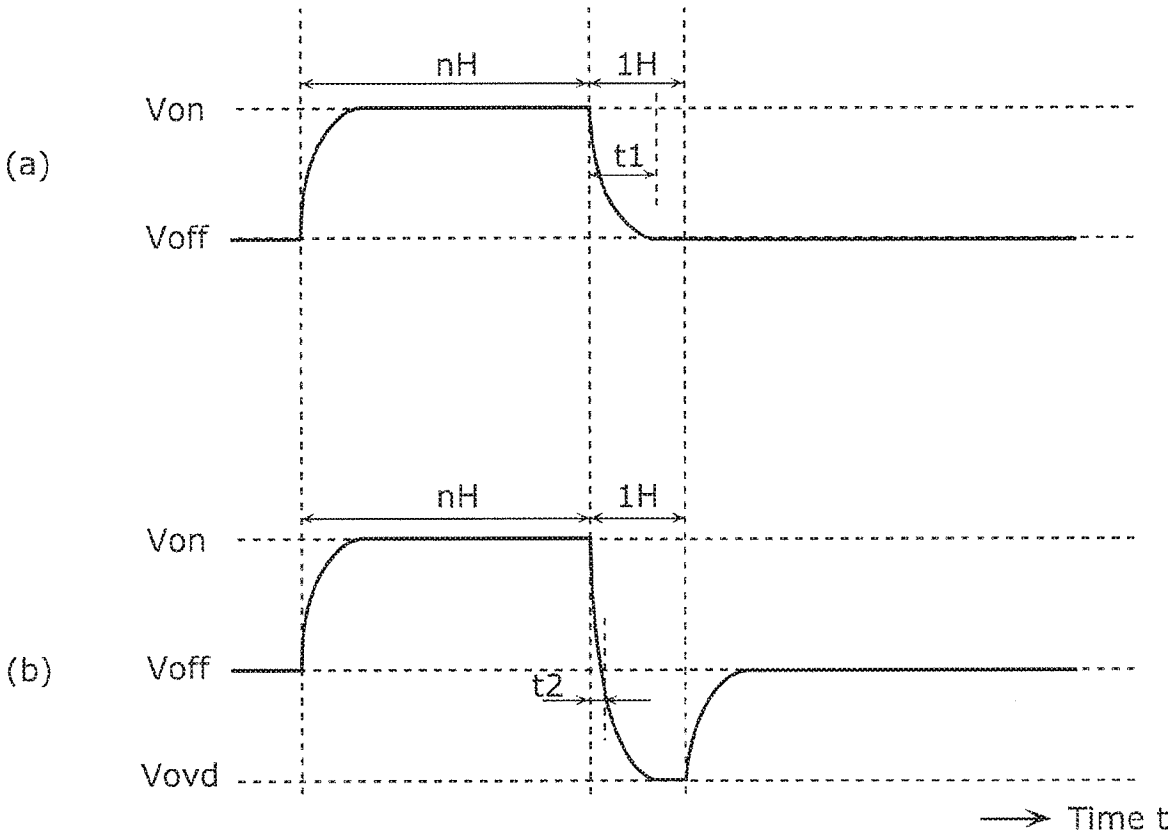
FIG. 20 is an explanatory diagram in (a) and (b) of the gate driver circuit according to the embodiment.
Figure 27:
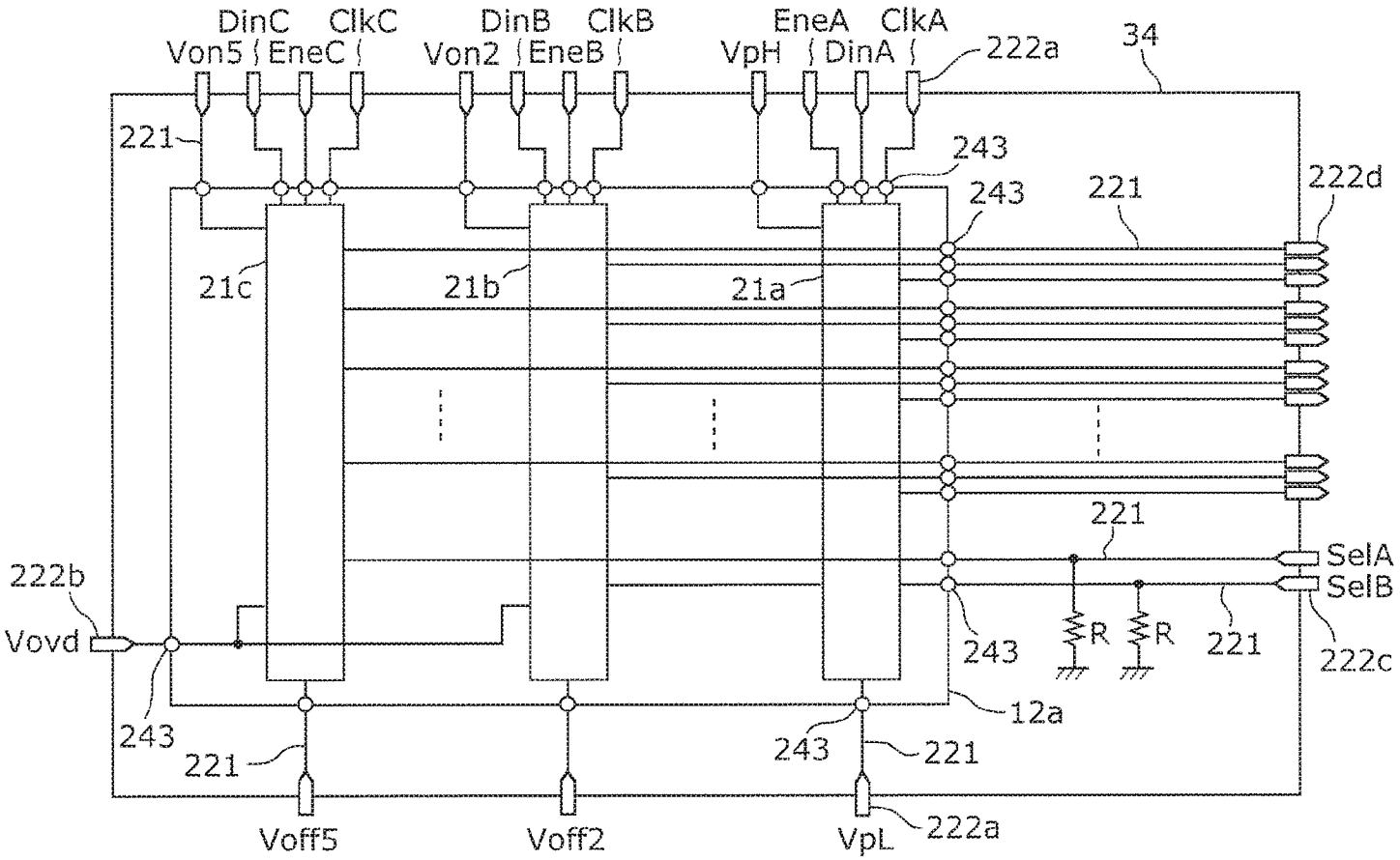
FIG. 27 is a configuration diagram of the gate driver circuit according to the embodiment.

Part (a) of FIG. 20 is a timing chart for a gate signal line illustrating an example of two-gate-voltage driving. In the case of two-gate-voltage driving, a later described Sel terminal (SelA) in FIG. 27 is at "low" level. Note that "high" and "low" may be expressed and illustrated as "H" and "L", respectively.

Note that the Sel terminal is pulled down by a resistor R, within the COF 34 or the gate driver IC 31, for instance. In other words, the Sel terminal is set to "low" by default. Accordingly, even if the Sel terminal is in an open state (released state), two-gate-voltage driving is selected.

Part (b) of FIG. 20 is a timing chart for a gate signal line illustrating three-gate-voltage driving. In synchronization with a rise in a clock of a shift register, the selection terminals (SelA) are sequentially selected and the selected selection terminal is set to "high" level by the application of the Von voltage. This sets driving of the scanning buffer circuit 21*a* of the gate driver circuit 12 (22) to three-gate-voltage driving. Note that setting a SelB terminal to "high" level sets driving of the scanning buffer circuit 21*c* (gate signal drive) to three-gate-voltage driving. A period during which the Vovd voltage is applied is a period of 1H.

Figure 21:
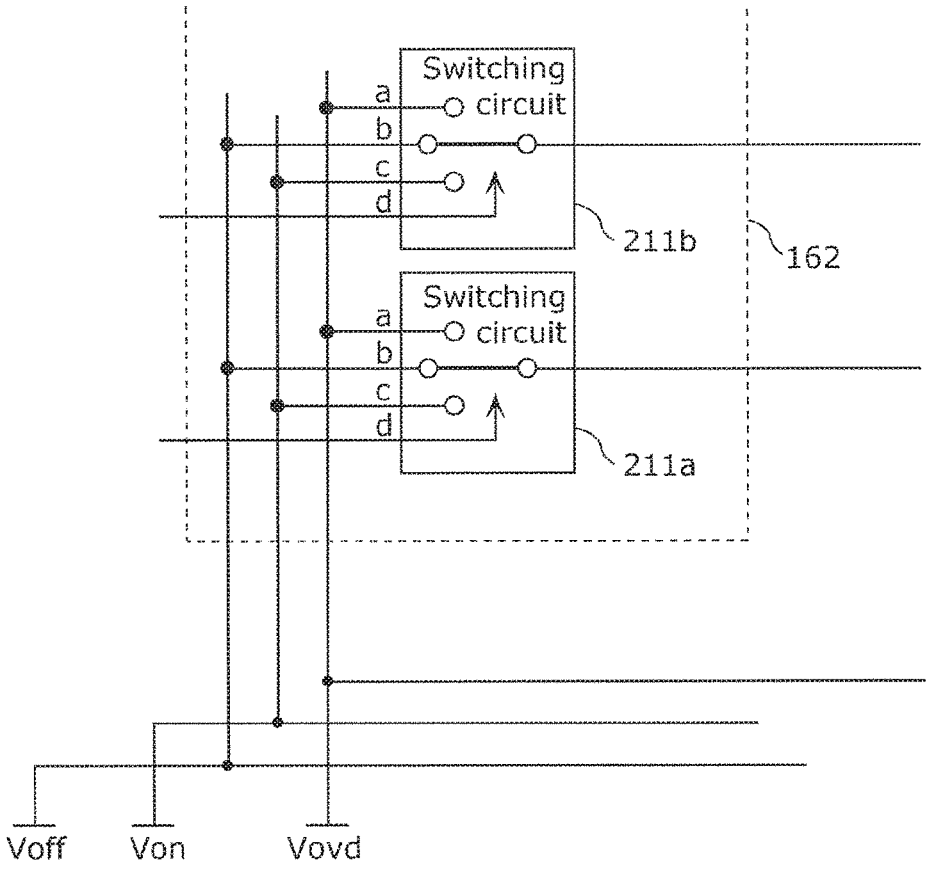
FIG. 21 is a configuration diagram of the gate driver circuit according to the embodiment.

FIG. 21 is an explanatory diagram of a switching circuit according to the embodiment. Switching circuits 211*a* and 211*b* have a function of selecting one voltage from among the Voff voltage, the Vovd voltage, and the Von voltage, and outputting the selected voltage to a gate signal line 17. As illustrated in FIG. 21, the Vovd voltage is applied to terminals a of the switching circuits 211*a* and 211*b*, the Voff voltage is applied to terminals b thereof, and the Von voltage is applied to terminals c thereof. According to a logic signal applied to terminals d (2 bits), one of the Vovd, Voff, and Von voltages is selected. The logic signal applied to the terminals d is based on data held at a shift register 36.

The switching circuits 211*a* and 211*b* switch output from the Von voltage to the Vovd voltage and then to the Voff voltage, thus achieving three-gate-voltage driving. On the other hand, the switching circuits 211*a* and 211*b* switch output from the Von voltage to the Voff voltage, thus achieving two-gate-voltage driving.

Figure 22:
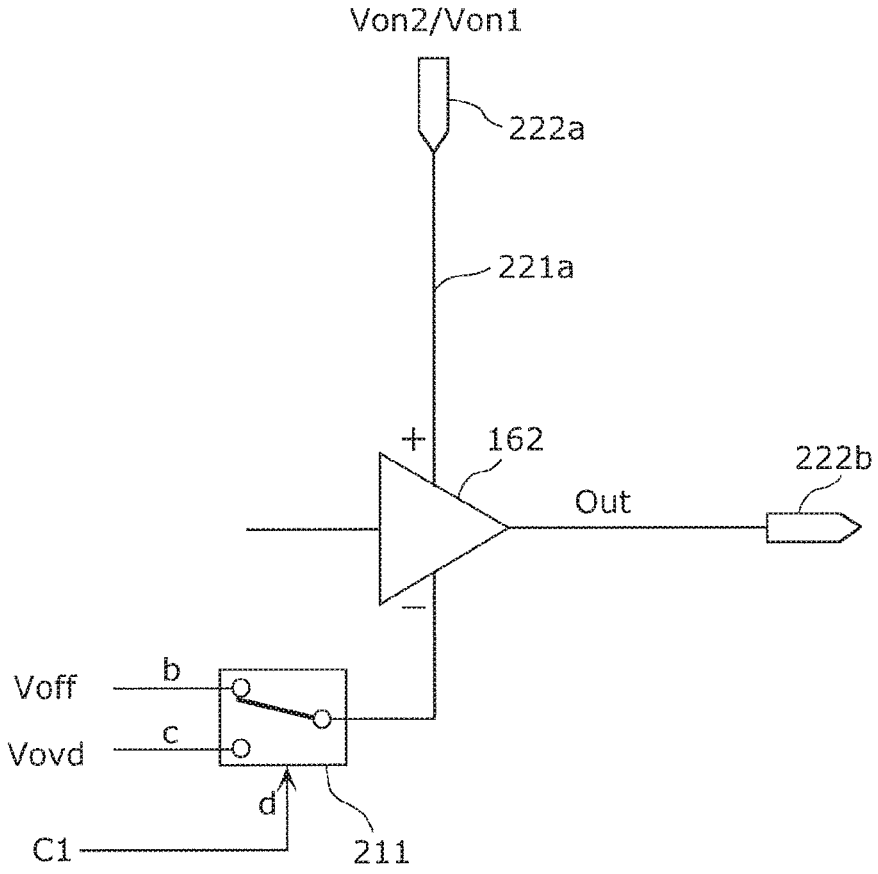
FIG. 22 is a configuration diagram of the gate driver circuit according to the embodiment.

FIG. 22 illustrates an example of a configuration of the gate driver circuit according to the embodiment. As illustrated in FIG. 22, the Von2 voltage or the Von1 voltage is applied via a terminal (driver input terminal) 222*a*. A voltage applied via the terminal 222*a* is transmitted to the output circuit 162 through a COF line 221*a* formed on the COF 34.

A switching circuit 211 is connected to the negative power (−power) terminal of the output circuit 162. On the other hand, an on voltage is applied to the plus power (+power) terminal of the output circuit 162.

The on voltage (Von voltage) output via the Out terminal can be changed by changing the on voltage applied to the terminal 222*a*. Furthermore, to the switching circuit 211, the overload voltage Vovd and the off voltage Voff voltage are input, the overload voltage Vovd or the off voltage Voff voltage is selected according to a logic signal supplied to a control terminal C1 of the switching circuit 211, and the selected voltage is applied to the negative power (−power) terminal of the output circuit 162.

According to the above configuration, one of the Von voltage, the Voff voltage, and the Vovd voltage is output via the Out terminal, and three-gate-voltage driving or two-gate-voltage driving is performed.

Figure 23:
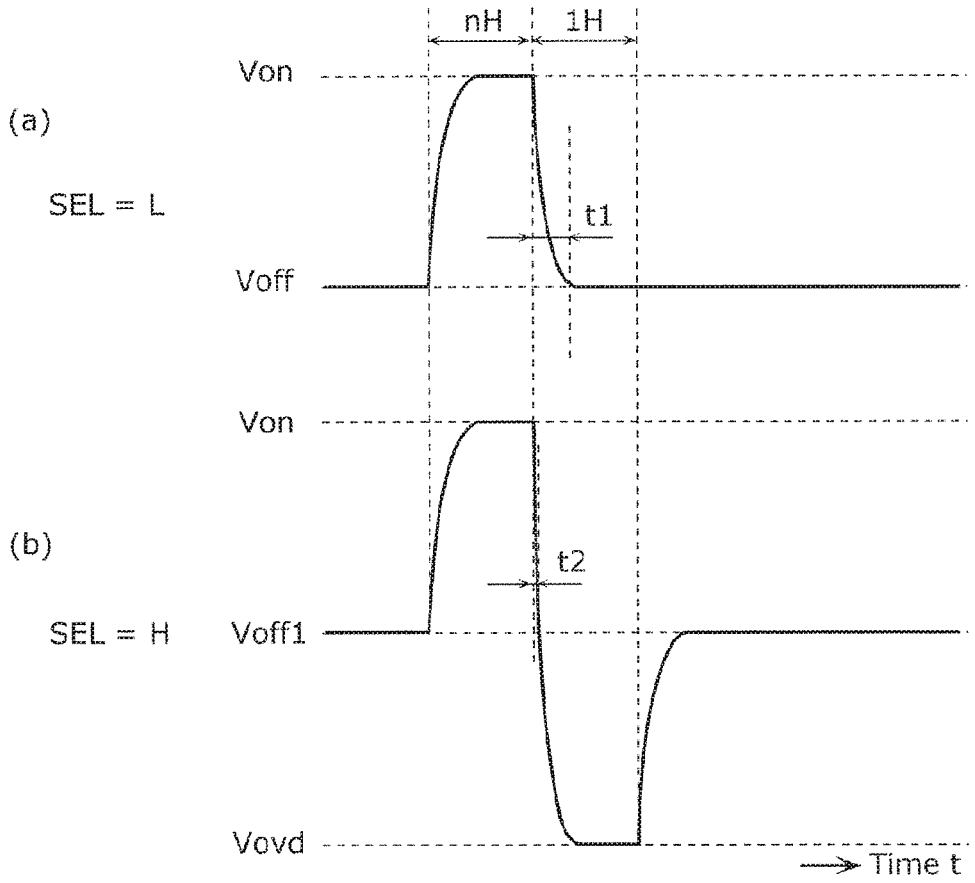
FIG. 23 is an explanatory diagram in (a) and (b) of the gate driver circuit according to the embodiment.

Parts (a) and (b) of FIG. 23 illustrate drive waveform diagrams illustrating details of a write control signal of the EL display apparatus according to the present embodiment, where (a) is a waveform diagram of two-gate-voltage driving, and (b) is a waveform diagram of three-gate-voltage driving.

Parts (a) and (b) of FIG. 23 illustrate examples in which the circuit of the pixel 16 includes n-channel transistors. Note that the polarity of the voltage waveform is reversed for when transistors 11 are n-channel transistors and when transistors 11 are p-channel transistors.

As illustrated in (a) of FIG. 23, according to two-gate-voltage driving, when t1 denotes a period for the Von voltage to change to the Voff voltage, if t1 is long, a video signal written to a pixel leaks in this period, and also crosstalk, for instance, occurs between vertically adjacent pixels.

As illustrated in (b) of FIG. 23, according to three-gate-voltage driving, after the Von voltage is applied to the output terminals of the gate driver circuits 12*a* and 12*b*, the Vovd voltage is applied, and then after the subsequent 1H period, the Voff voltage is further applied. In other words, during three-gate-voltage driving, the Vovd voltage is always applied when a transition is made from the Von voltage to the Voff voltage.

If three-gate-voltage driving illustrated in (b) of FIG. 23 is performed, as illustrated in the drawing, a period for a voltage to change from the Von voltage to the Voff voltage is t2, which is a very short time. Accordingly, a video signal written to a pixel does not leak, and crosstalk, for instance, does not occur between vertically adjacent pixels.

During three-gate-voltage driving, after a period in which the Von voltage is applied, the Vovd voltage is applied during a period of 1H or shorter. Note that according to the configurations in FIGS. 23 and 25, the Vovd voltage is applied during a period of 1H or longer. A period of 1H is one horizontally scanning period or a selection period for selecting one pixel row.

After the period in which the Vovd voltage is applied, the Voff voltage is applied to gate signal lines 17 for the selected pixel row, and the gate signal lines 17 are maintained at the Voff voltage during a period until the Von voltage is applied in the next frame period.

If a logic voltage applied to the Sel terminal is a "L" voltage, a two-gate-voltage driving mode is set. If a logic voltage applied to the Sel terminal is a "H" voltage, a three-gate-voltage driving mode is set.

Note that a period in which the Vovd voltage is applied is preferably set to a period of 1H or shorter. A period in which the Von voltage is applied is at least a period of 1H, and is n times the period of 1H (n is an integer of one or more). The value of n is configured to be changeable.

Note that according to the drive method (three-gate-voltage driving) of outputting the Vovd voltage to a gate signal line, in addition to a Von terminal and a Voff terminal, a Vovd terminal is provided to each of the gate driver circuits 12*a* and 12*b* according to an aspect of the present disclosure.

Figure 24:
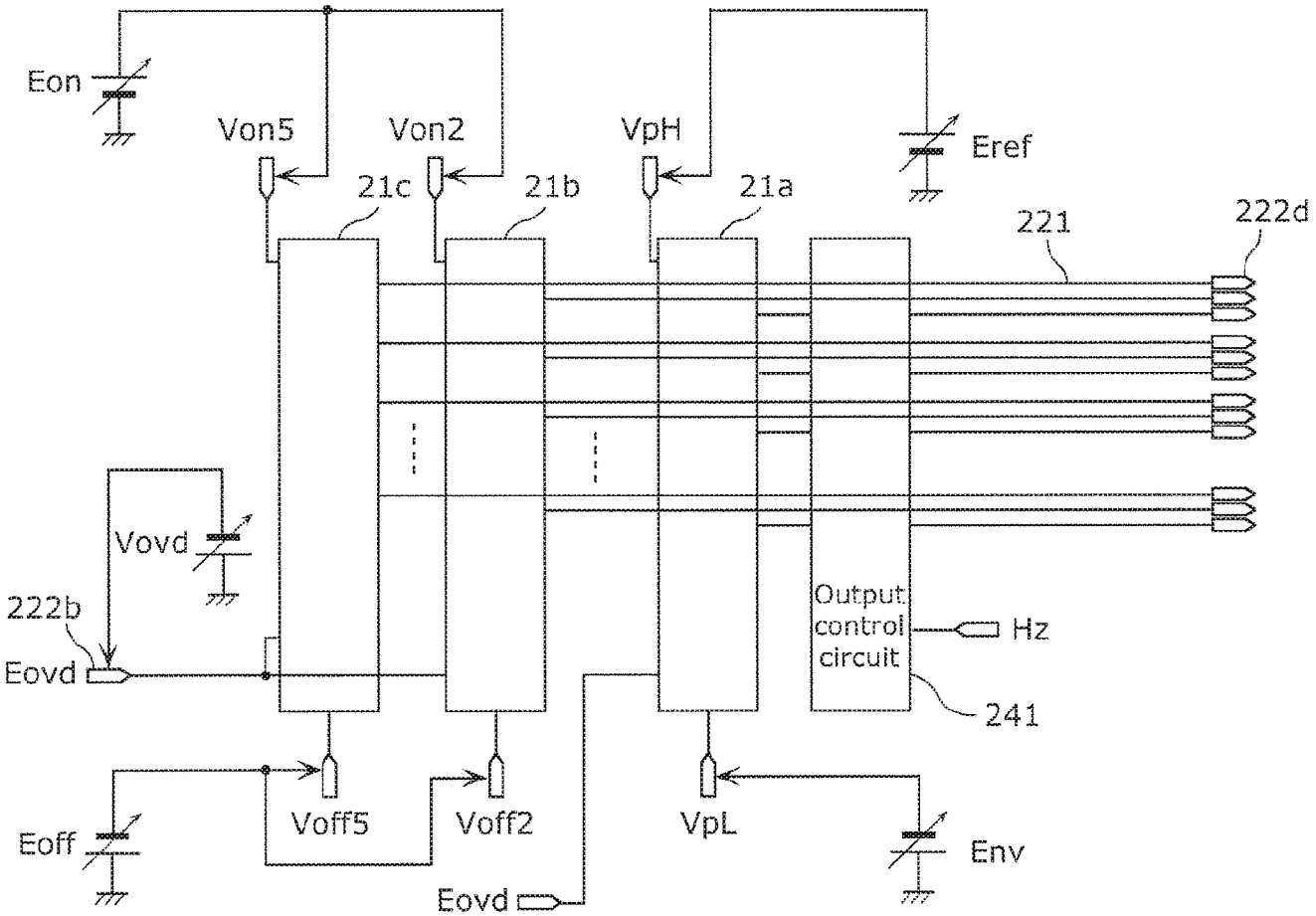
FIG. 24 is a configuration diagram of the gate driver circuit according to the embodiment.
Figure 25:
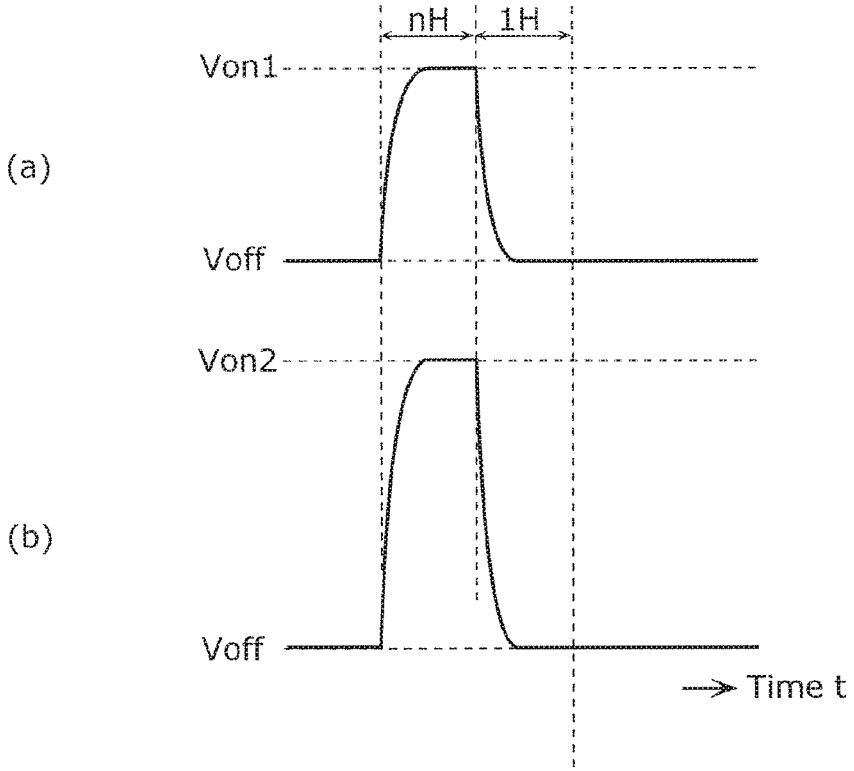
FIG. 25 is an explanatory diagram in (a) and (b) of the gate driver circuit according to the embodiment.

FIG. 24 illustrates control of changing an on voltage or an off voltage of the scanning buffer circuits 21*a* to 21*c*, according to the present embodiment. FIG. 25 is a waveform diagram of the on voltage of the scanning buffer circuits 21*a* to 21*c* which is controlled and changed. Specifically, the waveform diagrams in FIG. 25 show examples of two-gate-voltage driving. Note that in FIG. 24, if an Eovd voltage, an Eon voltage, and an Eoff voltage are changed, the drive waveform can be changed also in three-gate-voltage driving.

As illustrated in FIG. 24, the on voltages (Von2, Von5) to be applied to the scanning buffer circuits 21*b* and 21*c* are set by a voltage circuit Eon outside the COF. The voltage circuit Eon corresponds to a switching power supply circuit or a regulator circuit, for instance. The voltage circuit Eon outputs the Von voltages (Von2, Von5) to be applied to the scanning buffer circuits 21*b* and 21*c*.

The off voltage Voff to be applied to the scanning buffer circuits 21*b* and 21*c* is set by the voltage circuit Eoff outside the COF. The voltage circuit Eoff corresponds to a switching power supply circuit or a regulator circuit, for instance. The voltage circuit Eoff outputs the Voff voltage to be applied to the scanning buffer circuits 21*b* and 21*c*. At least two or more Voff terminals are formed or disposed on each of the gate driver circuits 12*a* and 12*b*.

A first voltage VpH to be applied to the scanning buffer circuit 21*a* is set by a voltage circuit Eref outside the COF. The voltage circuit Eref corresponds to a switching power supply circuit or a regulator circuit, for instance. A second voltage VpL to be applied to the scanning buffer circuit 21*a* is set by a voltage circuit Env outside the COF. The voltage circuit Env corresponds to a switching power supply circuit or a regulator circuit, for instance.

As illustrated in FIG. 25, the amplitude of a voltage applied to a gate signal line 17 can be changed by setting the magnitude of the Von voltage. In (a) of FIG. 25, the on voltage is Von1, and in (b) of FIG. 25, the on voltage is Von2. The on voltages are such that Von1<Von2. Such voltage setting can be made by the scanning buffer circuits 21*a* to 21*c*. Note that a time during which the Von voltage is applied is set to nH (n is an integer of one or more), and the value of n is configured so as to be changed by a controller (not illustrated).

As with the Von voltage, the Voff and Vovd voltages and the voltage Von are also configured to be changed, adjusted, or set by the scanning buffer circuits 21*b* and 21*b*.

Note that in the embodiment as illustrated in FIG. 24, the common Von, Voff, and Vovd voltages are used for the scanning buffer circuits 21*c* and 21*b*. The VpH voltage and the VpL voltage applied to the scanning buffer circuit 21*a* are different from those applied to the scanning buffer circuits 21*c* and 21*b*.

The scanning buffer circuit 21*a* applies the first voltage and the second voltage which are to be applied to the voltage signal line 23, and the scanning buffer circuits 21*b* and 21*c* apply the on voltage or the off voltage to the gate signal lines 17, Accordingly, operation of outputting two types of voltages to COF lines 221 on the COF 34 is the same, but the effect of the voltages to be output are different. Note that the Vovd terminal of the scanning buffer circuit 21*a* is released (open). Alternatively, the Env voltage is applied to the Vovd terminal of the scanning buffer circuit 21*a*. Note that 222 denotes a connection terminal which connects the COF 34 and an external line of a panel, for instance, and 221 denotes a line formed on the COF 34.

In FIG. 24, 241 denotes an output control circuit. The output control circuit 241 is disposed on the output side of the scanning buffer circuit 21*a*. The output control circuit specifically corresponds to a switching circuit. By turning off the switching circuit, the output of the scanning buffer circuit 21*a* is not output from a terminal 222*d*. In other words, the output of the output control circuit 241 will be in a high impedance state (HiZ). Specifically, the gate driver circuits 12*a* and 12*b* place the first gate signal line in the high impedance state (HiZ) without outputting a reference voltage which is the first voltage (Vref) and a reverse bias voltage (Vnv) which is the second voltage in between when the drive transistor is placed in the first state and when the drive transistor is placed in the second state.

Setting the high impedance state (HiZ) and setting the output state of the on voltage and the off voltage are established according to a logic signal applied to a terminal Hz. By setting a Hz signal to H level, a switch (not illustrated) in the output control circuit 241 will be open. By setting the Hz signal to L level, a switch (not illustrated) in the output control circuit 241 is turned on, and the output of the scanning buffer circuit 21*a* is output to the terminal 222*d*, and is applied to the voltage signal line 23.

A switch (not illustrated) in the output control circuit 241 can be achieved by controlling the transistors 163*a*, 163*b*, and 163*c* included in the output circuit 162 illustrated in FIGS. 16 and 18 described above. By turning off all the transistors 163*a*, 163*b*, and 163*c*, the OutA terminal will be placed in the high impedance state. Thus, the Von voltage is output from the OutA terminal if only the transistor 163*a* is turned on. If only the transistor 163*b* is turned on, the Voff voltage is output from the OutA terminal. If only the transistor 163*c* is turned on, the Vovd voltage is output from the OutA terminal. The OutA terminal can be placed in the high impedance state by turning off all the transistors 163*a*, 163*b*, and 163*c*.

Figure 26:
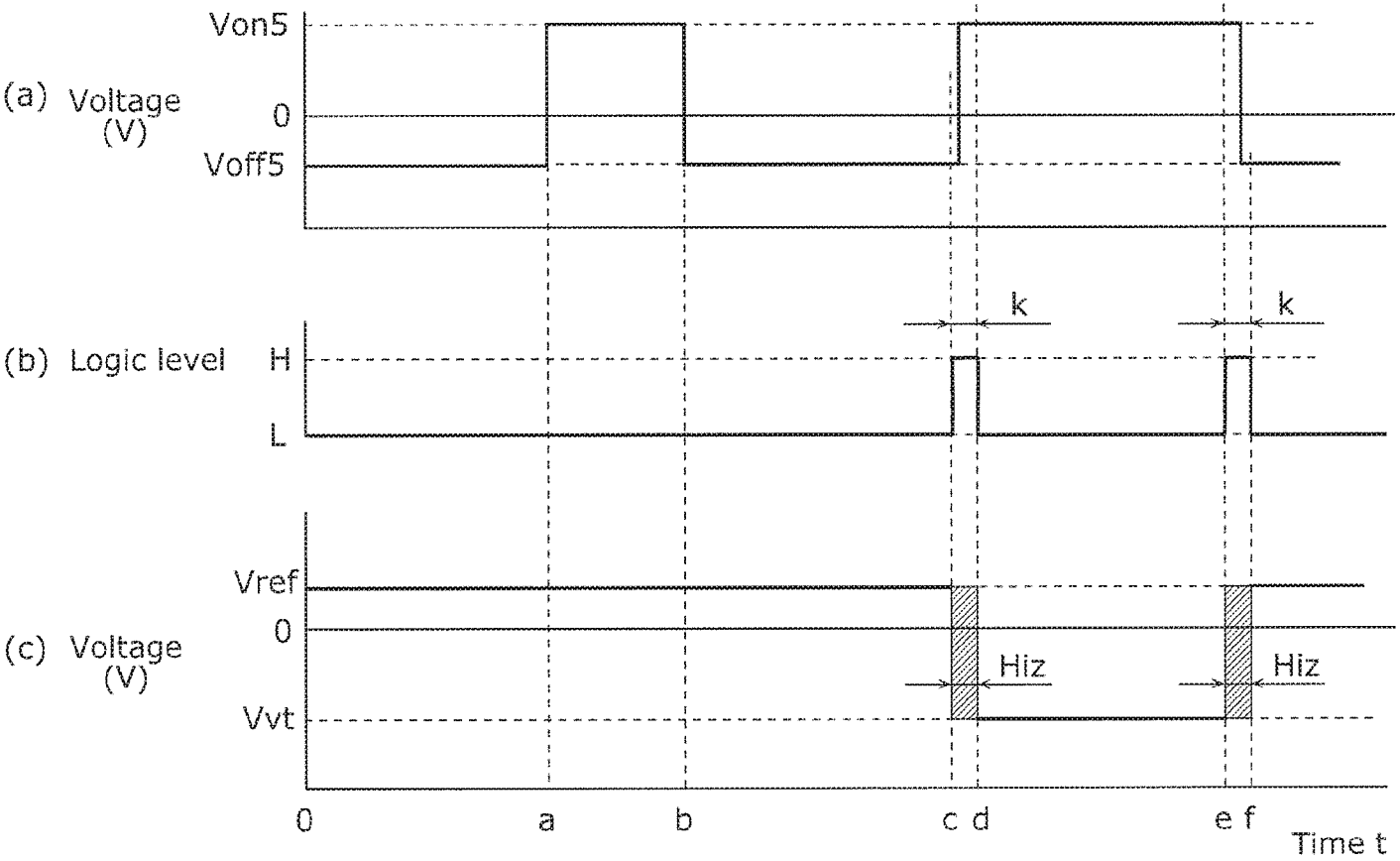
FIG. 26 is a timing chart in (a)-(c) of the gate driver circuit according to the embodiment.

FIG. 26 is a timing chart with regard to a method of controlling the Hz signal. FIG. 26 is an explanatory diagram conceptually illustrating an operating state of the switch transistor 11*e*. The reference voltage (Vref) or the reverse bias voltage (Vnv) is applied to the gate terminal of the drive transistor 11*a*, by applying the Von5 voltage (operating voltage) to the gate terminal of the switch transistor 11*e*. If the Voff5 voltage (non-operating voltage) is applied to the gate terminal of the switch transistor 11*e*, the switch transistor 11*e* is turned off, which prevents a voltage applied to the voltage signal line 23 from being applied to the drive transistor 11*a*.

Part (c) of FIG. 26 is a diagram with regard to the voltage signal line 23. In (c) of FIG. 26, the reference voltage (Vref) is applied to the voltage signal line 23 between time 0 and time c. The reverse bias voltage Vnv is applied between time d and time e.

Part (a) of FIG. 26 is a diagram with regard to the gate signal line 17*e*. In (a) of FIG. 26, Voff5 (off voltage) or Von5 (on voltage) are applied to the gate signal line 17*e*.

On and off of the switch transistor 11*e* are controlled by the voltage applied to the gate signal line 17*e*, and a voltage applied to the voltage signal line 23 (reference voltage (Vref), reverse bias voltage (Vnv)) is applied to the gate terminal of the drive transistor 11*a*. However, if the voltage applied to the gate terminal of the drive transistor 11*a* is rapidly changed, a transient phenomenon may have a harmful effect such as breaking the drive transistor 11*a*.

In order to solve this, a control signal is applied to a Hz signal and the output of the output control circuit 241 is controlled. Specifically, the output of the output control circuit 241 is placed in the high impedance state (HiZ) in the c-d period and the e-f period (k periods). The on and off states of the gate signal line 17*e* are changed in the periods. Accordingly, the voltage signal line 23 will be floating, namely, will be in the high impedance state (HiZ) in the c-d period and the e-f period, and the occurrence of a transient phenomenon is reduced when the voltage changes from the reference voltage (Vref) to the reverse bias voltage (Vnv) and from the reverse bias voltage (Vnv) to the reference voltage (Vref). This prevents a rapid change in a voltage applied to the gate terminal of the drive transistor 11*a*, and thus the drive transistor 11*a* can be prevented from being broken.

Note that the output control circuit 241 is disposed only on the output side of the scanning buffer circuit 21*a* in FIG. 24, but the present embodiment is not limited to this. For example, a configuration may be adopted in which the output control circuit (not illustrated) 241 is disposed for each of the scanning buffer circuit 21*b* and the scanning buffer circuit 21*c*, and each output control circuit 241 can be controlled so that the output control circuits 241 are independently placed in the high impedance state.

FIG. 27 is a configuration diagram and an explanatory diagram for the gate driver circuit 12*a* (or the gate driver circuit 12*b*) for driving the EL display apparatus according to the present embodiment. In FIG. 27, a terminal 243 is an output terminal or an input terminal of the scanning buffer circuits 21*a* to 21*c*. Terminals 222*a* to 222*d* are connection terminals for connecting to the gate driver circuit 12*a* (or the gate driver circuit 12*b*). The gate signal lines 17*a* to 17*e* are connected to the terminals 222*a* to 222*d* by ACF resin.

Clock input terminals Clkx (x=A, B, C) are connected to the scanning buffer circuits 21. Data input terminals Dinx (x=A, B, C) through which data is input are also connected to the scanning buffer circuits 21. Furthermore, enable terminals Enex (x=A, B, C) for switching the output of the scanning buffer circuits 21 between active and inactive are also connected to the scanning buffer circuits 21.

From the above, the scanning buffer circuits 21*a*, 21*b*, and 21*c* can be independently operated based on docks. Furthermore, the scanning buffer circuits 21*a*, 21*b*, and 21*c* can input different input data.

Figure 28:
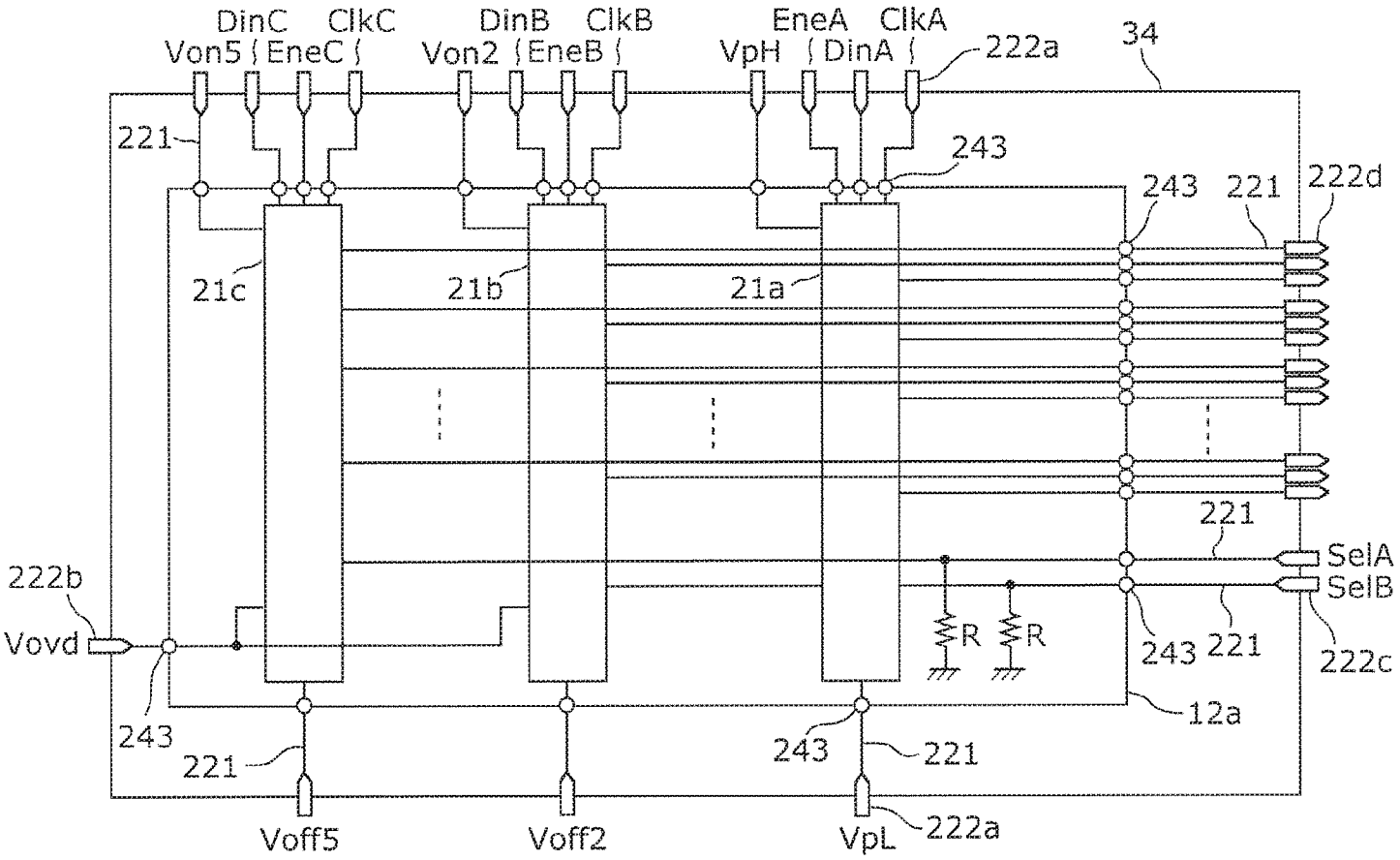
FIG. 28 is a configuration diagram of the gate driver circuit according to the embodiment.

In the embodiment illustrated in FIG. 28, the gate driver circuit 12*a* (or the gate driver circuit 12*b*) is configured to set or apply the on voltage Von, the off voltage Voff, or the overload voltage Vovd to the scanning buffer circuits 21*a* to 21*c*.

Although the gate driver circuit 12 is configured to set or apply the on voltage Von, the off voltage Voff, and the overload voltage Vovd to each of the scanning buffer circuits 21*a* to 21*c*, the gate driver circuit 12 applies the on voltage Von and the off voltage Voff to the scanning buffer circuits 21*b* and 21*c* independently, and applies the overload voltage Vovd to all the scanning buffer circuits 21*a* to 21*c*, in the embodiment illustrated in FIG. 28.

VpH is applied to the scanning buffer circuit 21*a* as the on voltage Von, and VpL is applied thereto as the off voltage Voff. The off voltage Voff is applied to the input terminal for the overload voltage Vovd. If the overload voltage Vovd is not used, the input terminal for the overload voltage Vovd may be open, yet applying the off voltage Voff stabilizes the scanning buffer circuits 21. Furthermore, design for pressure resistance of the scanning buffer circuits 21 can be readily made. The voltage equal to or less than the off voltage Voff is applied to the input terminal for the overload voltage Vovd.

SelA and SelB which are selection terminals (Sel terminals) are connected to the scanning buffer circuits 21*b* and 21*c*. Note that the Sel terminal (not illustrated) of the scanning buffer circuit 21*a* is used being open. The Sel terminals (SelA, SelB) are pulled down. The Sel terminals are logic terminals which switch between three-gate-voltage driving and two-gate-voltage driving.

As described above, the gate driver circuits 12*a* and 12*b* according to the present embodiment are configured to set or apply the on voltage Von, the off voltage Voff, and the overload voltage Vovd to the scanning buffer circuits 21*a* to 21*c*. Furthermore, the VpH voltage can be applied via an application terminal for the on voltage, and the VpL voltage can be applied via an application terminal for the off voltage.

With this configuration, the gate driver circuit 12*a* (or the gate driver circuit 12*b*) can apply, to the gate signal line 17*a* which is the first gate signal line, the voltage VpH as the reference voltage Vref which is the first voltage. Furthermore, the gate driver circuit 12*a* (or the gate driver circuit 12*b*) can apply, to the gate signal line 17*a* which is the first gate signal line, the voltage VpL as the reverse bias voltage (Vnv) which is the second voltage. This yields a long-lived, high-quality EL display apparatus which prevents variations in the rise voltage (VT voltage) of the drive transistor.

Placing the voltage signal line 23 in the high impedance state (HiZ) reduces occurrence of a transient phenomenon due to changes of an applied voltage from the reference voltage (Vref) to the Vnv voltage and from the Vnv voltage to the reference voltage (Vref). This prevents a rapid change in the voltage applied to the gate terminal of the drive transistor 11*a*, and prevents the drive transistor 11*a* from being broken.

Note that whether two-gate-voltage driving or three-gate-voltage driving is to be performed is determined based on a logic voltage applied to selection signal lines (specifically, the Sel terminals SelA and SelB) illustrated in FIGS. 27 and 28.

[Other embodiments]

The following describes other embodiments collectively. An EL display apparatus according to the present embodiment differs from the EL display apparatus illustrated in FIG. 1 in the configuration of transistors in a pixel or the configuration of a gate driver circuit.

Figure 29:
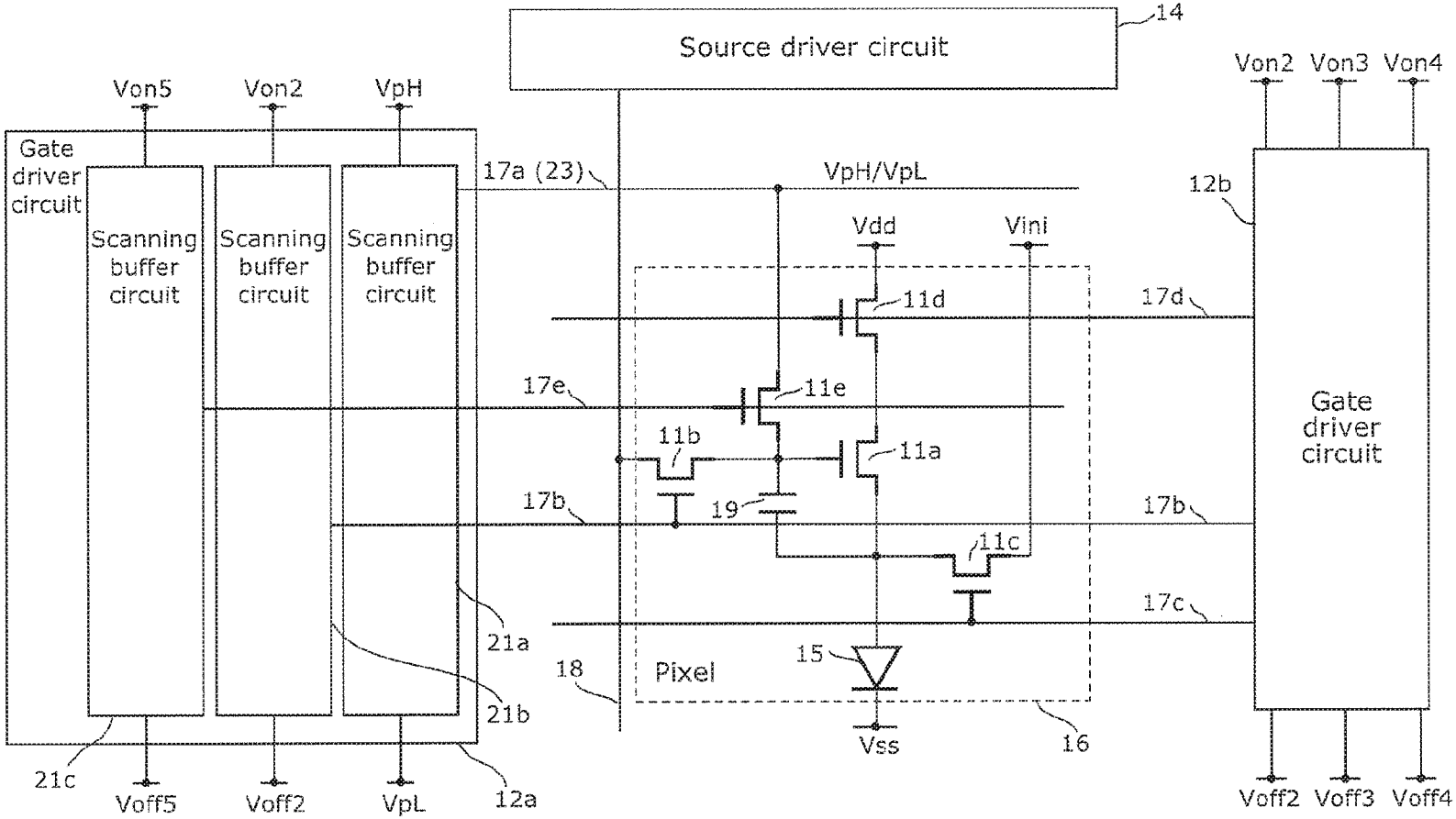
FIG. 29 is a configuration diagram of an EL display apparatus according to another embodiment.

FIG. 29 is a configuration diagram of an EL display apparatus according to the present embodiment. FIGS. 30 to 34 are explanatory diagrams of a circuit illustrating operation of the pixel illustrated in FIG. 29. All the transistors included in the pixel are N-type transistors in FIGS. 29 to 34.

In the EL display apparatus illustrated in FIG. 29, a switch transistor 11*d* is disposed between an anode voltage Vdd and the drain terminal of a drive transistor 11*a*, rather than between the source terminal of the switch transistor 11*b* and the gate terminal of the drive transistor 11*a*, as illustrated in FIG. 1, In the pixel circuit illustrated in FIG. 29, a capacitor 19 has a first electrode electrically connected to the gate terminal of the drive transistor 11*a*, and a second electrode electrically connected to the source terminal of the drive transistor 11*a*.

In a stationary state, the capacitor 19 first stores a potential between the gate and source electrodes of the drive transistor 11*a* (potential of a source signal line 18), while a switch transistor 11*b* is electrically connected. After that, even if the switch transistor 11*b* is turned off, a potential of the capacitor 19 is fixed, and thus a gate voltage of the drive transistor 11*a* is fixed.

In the EL display apparatus illustrated in FIG. 1, if a pixel circuit illustrated in FIG. 29 is employed, an anode voltage Vdd, a cathode voltage Vss, a reference voltage (Vref), and an initializing voltage (Vini) are connected to all the pixels 16 in common, and connected to a voltage generation circuit (not illustrated). Furthermore, if a voltage obtained by adding a light emission starting voltage of an EL element 15 to a threshold voltage of the drive transistor 11*a* is greater than 0 V, Vini may be a voltage substantially the same as the cathode voltage Vss. This reduces types of voltages output from the voltage generation circuit (not illustrated), and further simplifies the circuit.

Note that the pixel circuit illustrated in FIG. 29 preferably satisfies the following relationship: anode voltage Vdd>reference voltage Vref>cathode voltage Vss>initial voltage Vini. Specifically, as an example, the anode voltage Vdd=10 to 18 (V), the reference voltage Vref=1.5 to 3 (V), the cathode voltage Vss=0.5 to 2.5 (V), and the initial voltage Vini=0 to −3 (V).

Figure 30:
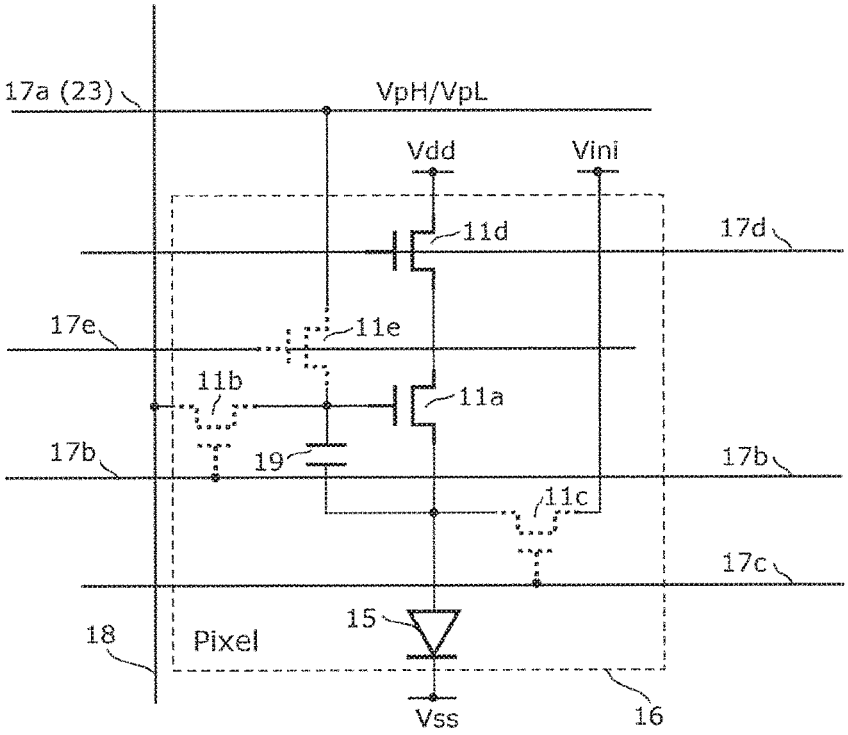
FIG. 30 is an explanatory diagram of a circuit, for illustrating operation of a pixel according to the other embodiment.

FIG. 30 illustrates a pixel operating state during a light emission period. As illustrated in FIG. 30, when the switch transistor 11*d* is on, a voltage is supplied to the EL element 15 through the anode voltage Vdd, thus causing the EL element 15 to emit light. A drive current (drain-source current) Id is supplied to the EL element 15 through the anode voltage Vdd via the drive transistor 11*a*, and thus the EL element 15 emits light at a brightness according to the drive current Id. By turning off the switch transistor 11*d*, a current which flows into the EL element 15 is interrupted, and light emission of the EL element 15 stops (the EL element 15 does not emit light).

Note that in the present embodiment, transistors disposed in a pixel 16 are not limited to N-type transistors. Only N-type transistors may be included or only P-type transistors may be included. Furthermore, both N-type and P-type transistors may be included. The drive transistor 11*a* may include both P-type and N-type transistors.

The switch transistors 11*b* to 11*e* are not limited to transistors, and for example, may be each an analog switch which includes both P-type and N-type transistors.

It is preferable to employ a top gate structure for the drive transistor 11*a* and the switch transistors 11*b* to 11*e*. That is because employing the top gate structure decreases parasitic capacitance, and allows a gate electrode pattern of the top gate serves as a light shielding layer which interrupts light emitted from the EL element 15, thus reducing malfunction of a transistor and an off leak current.

It is preferable to perform a process in which a copper line or a copper alloy line can be employed as the line material of gate signal lines 17*a* (23) to 17*e* or the source signal line 18, or all of the gate signal lines 17*a* (23) to 17*e* and the source signal line 18. This is because the line resistance of a signal line can be reduced and a larger EL display panel can be achieved.

The gate signal lines 17*a* (23) to 17*e* driven (controlled) by gate driver circuits 12*a* and 12*b* preferably have low impedance. The same also applies to the configuration or the structure of the source signal line 18.

Particularly, it is preferable to employ LTPS. LTPS allows producing N-type and P-type transistors having a top gate structure and less parasitic capacitance, and allows use of a process in which a copper line or a copper alloy line is employed. Note that it is preferable to employ the three-layered structure of Ti—Cu—Ti for a copper line.

It is preferable to employ a three-layered structure of Mo—Cu—Mo for lines such as the gate signal lines 17*a* to 17*e* and the source signal line 18, if the transistors 11*a* to 11*e* are TAOS.

Figure 31:
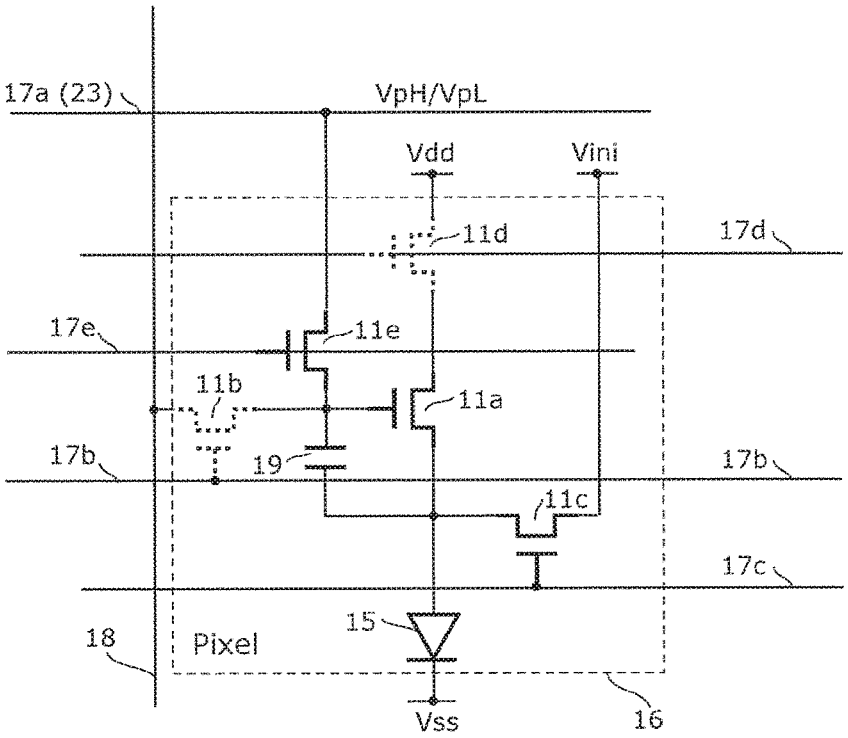
FIG. 31 is an explanatory diagram of the circuit, for illustrating operation of the pixel according to the other embodiment.

FIG. 31 illustrates a pixel operating state during a period for preparing offset cancellation. The reference voltage is supplied to the gate signal line 17*a* (23) during the period for preparing offset cancellation. The switch transistor 11*e* is turned on, the reference voltage Vref is applied to the gate terminal of the drive transistor 11*a*, the switch transistor 11*c* is turned on, and the initial voltage Vini is applied to the anode terminal of the EL element 15. A gate potential Vg of the drive transistor 11*a* becomes the reference voltage Vref. A source potential Vs of the drive transistor 11*a* becomes the initial voltage Vini sufficient lower than the reference voltage Vref.

Here, the initial voltage Vini is set such that a gate-source voltage Vgs of the drive transistor 11*a* is higher than an offset cancellation voltage Vth of the drive transistor 11*a*. In this manner, the gate potential Vg of the drive transistor 11*a* is initialized to the reference voltage Vref, and the source potential Vs is initialized to the low voltage Vini, thus completing preparation for offset cancellation operation.

Figure 32:
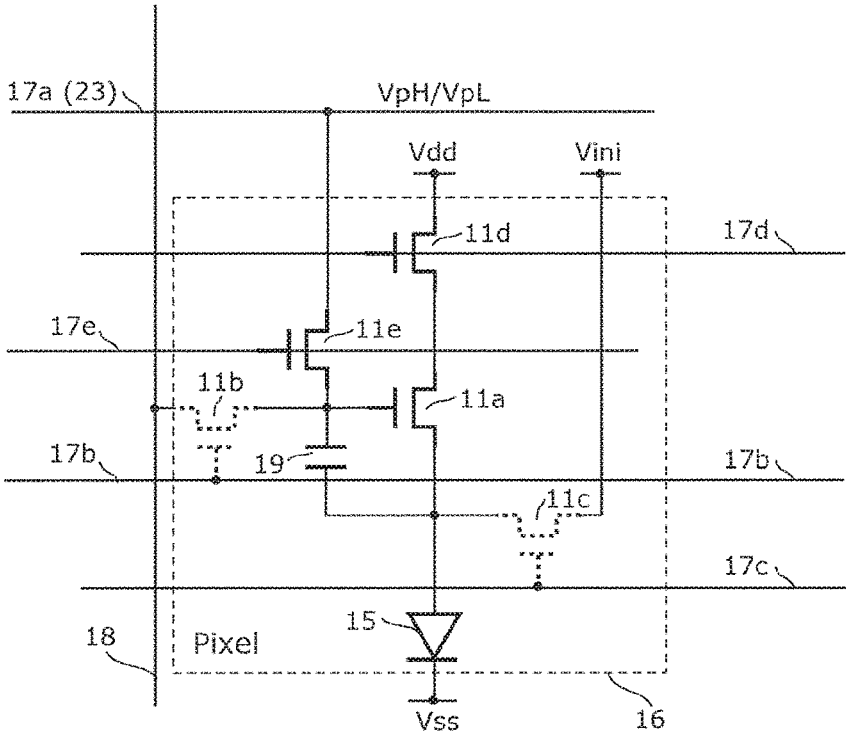
FIG. 32 is an explanatory diagram of the circuit, for illustrating operation of the pixel according to the other embodiment.

After that, as illustrated in FIG. 32, a selection voltage (on voltage) is applied to the gate signal line 17*d*, and the switch transistor 11*d* is turned on. Then, the anode voltage Vdd is applied to the drain terminal of the drive transistor 11*a*. Consequently, the source potential Vs of the drive transistor 11*a* starts increasing. In a short time, the gate-source voltage Vgs of the drive transistor 11*a* becomes the offset cancellation voltage Vth of the drive transistor 11*a*, and a voltage corresponding to the offset cancellation voltage Vth is written to the capacitor 19. Note that a scanning buffer circuit 21*a* of the gate driver circuit 12*a* supplies the switch transistor 11*e* with the reference voltage. Furthermore, a scanning buffer circuit 21*b* of the gate driver circuit 12*a* applies the on voltage to the gate signal line 17*e*, the switch transistor 11*e* is turned on, and the reference voltage is supplied to the gate terminal of the drive transistor 11*a*.

Here, for convenience, a period in which a voltage corresponding to the offset cancellation voltage Vth is written to the capacitor 19 is referred to as an offset cancellation period.

Note that during this offset cancellation period, a cathode voltage Vss at the cathode electrode is set so as to place the EL element 15 in the cutoff state, in order that a current mainly flows on the capacitor 19 side and does not flow on the EL element 15 side. Accordingly, the cathode voltage Vss is set such that Vss>Vini. For example, if Vss=+2 (V), Vini=−2 (V).

The gate of the drive transistor 11*a* is placed in the high impedance state, yet the gate-source voltage Vgs is equal to the offset cancellation voltage Vth of the drive transistor 11*a*. Thus, the drive transistor 11*a* is in the cutoff state. Accordingly, a drain-source current Id does not flow.

Figure 33:
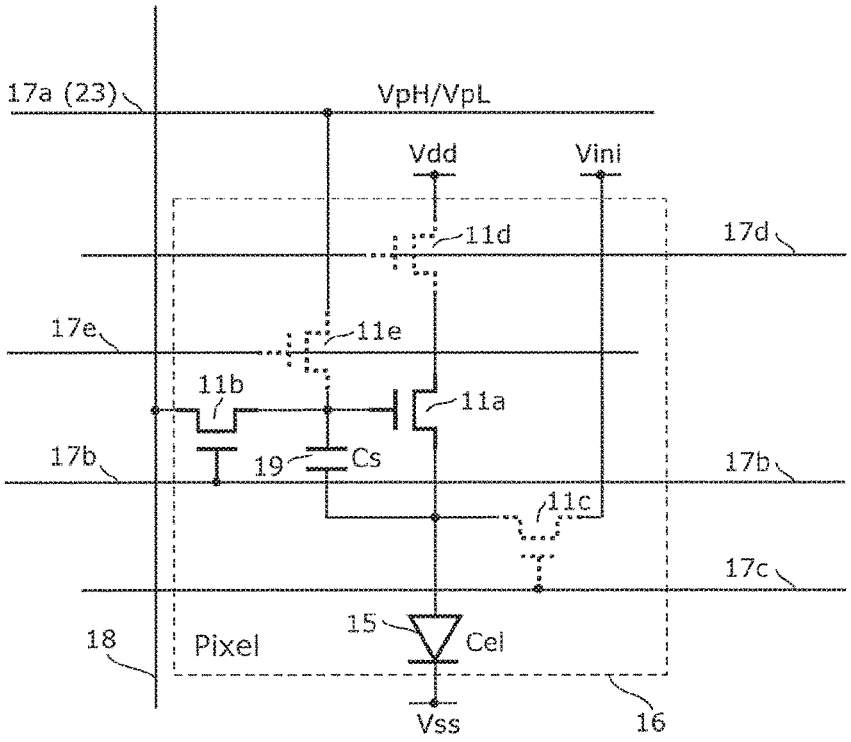
FIG. 33 is an explanatory diagram of the circuit, for illustrating operation of the pixel according to the other embodiment.

Next, as illustrated in FIG. 33, a source driver circuit 14 applies a video signal voltage Vsig to the source signal line 18. The selection voltage is applied to the gate signal line 17*b*, and thus the switch transistor 11*b* is electrically connected. The video signal voltage Vsig is thus applied to the gate terminal of the drive transistor 11*a* of the pixel 16. At this time, the EL element 15 is in the cutoff state (high impedance state), and thus can be regarded as a capacitor (referred to as Cel). Accordingly, the video signal voltage Vsig applied to the gate terminal of the drive transistor 11*a* is divided by a capacitor Cs and the EL capacitor Cel, and the divided voltage is applied between the gate and source terminals of the drive transistor 11*a*. The EL capacitor Cel is smaller than the capacitor Cs. Thus, most of the video signal voltage Vsig is applied between the gate and source terminals of the drive transistor 11*a*.

Note that in the present embodiment, the EL element 15 is used as the EL capacitor Cel, but the present embodiment is not limited to this. A capacitor may be separately formed in parallel with the EL element 15.

Figure 34:
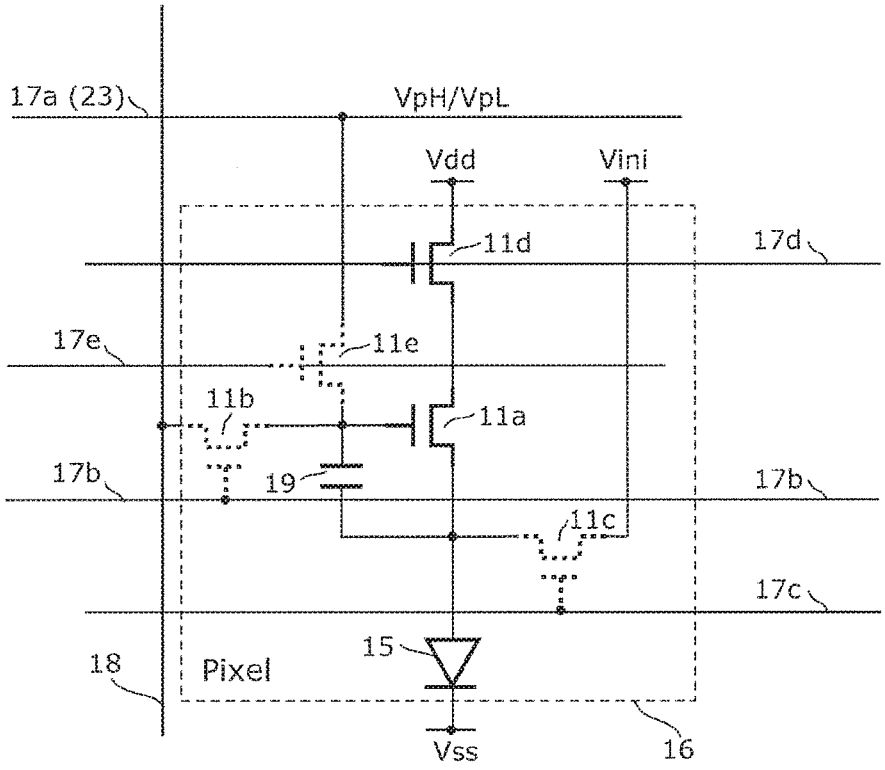
FIG. 34 is an explanatory diagram of a circuit for illustrating operation of a pixel according to the other embodiment.

Next, as illustrated in FIG. 34, the switch transistor 11*d* is turned on, and consequently the anode voltage Vdd is applied to the drain terminal of the drive transistor 11*a*. The current Id begins to flow by the application of the anode voltage Vdd. In proportion to the current Id, the EL element 15 emits light.

As described above, the EL display apparatus having the configuration illustrated in FIG. 29 performs offset cancellation on each pixel 16 of the display panel, thus controlling light emission and no light emission of each pixel.

Figure 35:
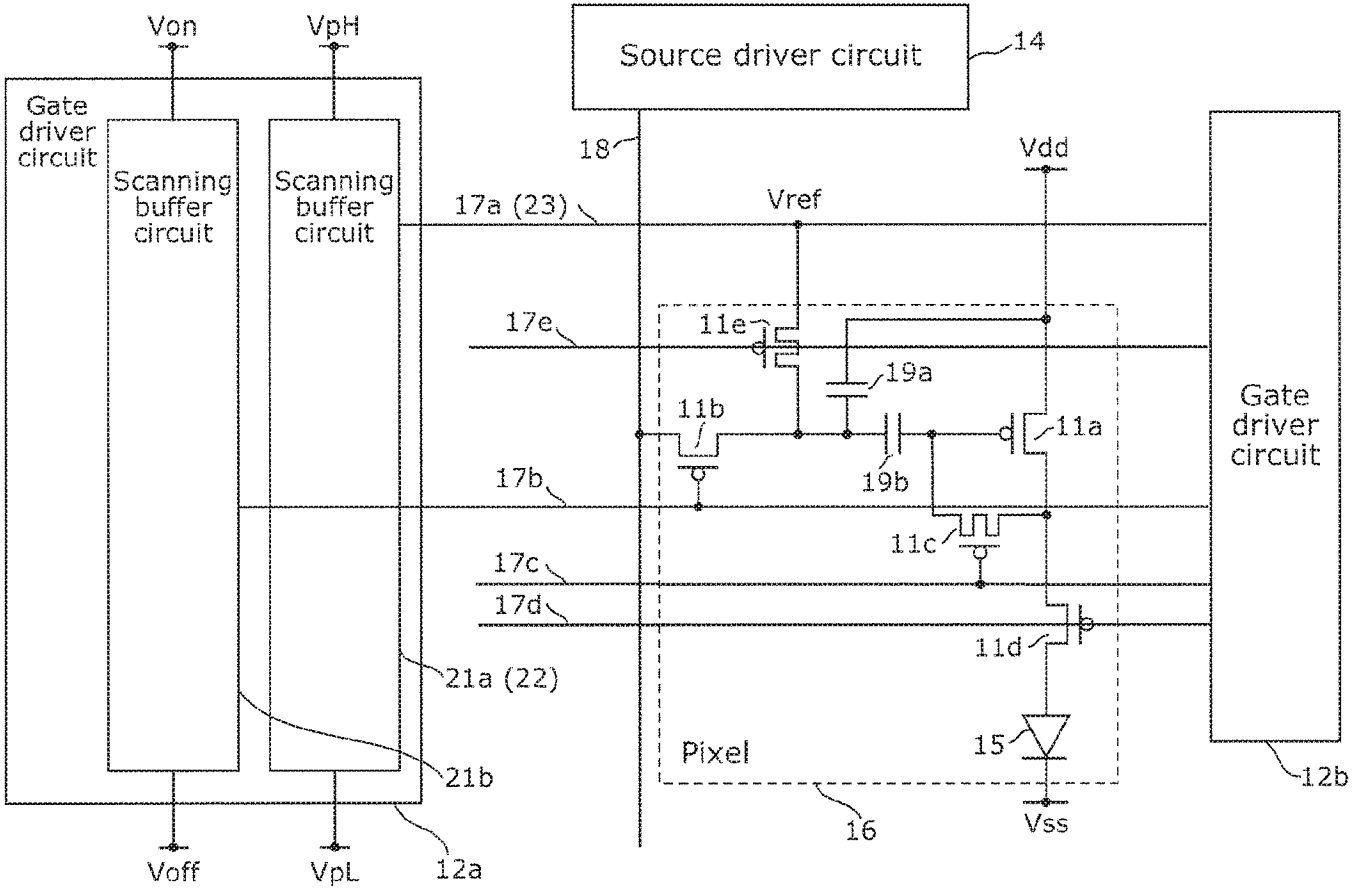
FIG. 35 is a configuration diagram of an EL display apparatus according to another embodiment.

The following describes the EL display apparatus according to another embodiment with reference to FIG. 35. Note that the above embodiments may be applied to the other embodiment or may be combined with the other embodiment.

In the EL display apparatus illustrated in FIG. 35, five transistors and five gate signal lines (17*e*, 17*a*, 17*b*, 17*c*, 17*d*) are formed in each pixel 16.

The gate driver circuit 12*a* is disposed for the gate signal lines 17*a* and 17*b*, and the gate driver circuit 12*b* is disposed for the gate signal lines 17*e*, 17*c*, and 17*d*.

Accordingly, the gate signal lines 17*a* and 17*b* are double-sided driven by the gate driver circuits 12*a* and 12*b*. Three-gate-voltage driving is performed on the gate signal line 17*b*. Note that two-gate-voltage driving is performed on the gate signal lines 17*e*, 17*c*, and 17*d*. The gate signal line 17*a* is for supplying the reference voltage (Vref) or the reverse bias voltage (Vnv) from the gate driver circuit 12*a* to a switch transistor 11*e*.

In the pixel 16 illustrated in FIG. 35, a first terminal of the p-channel drive transistor 11*a* is connected to an electrode or a line to which the anode voltage Vdd is applied, and a second terminal is connected to a first terminal of the switch transistor 11*d*. Furthermore, the gate terminal of the switch transistor 11*d* is connected to the gate signal lines 17*a* to 17*e*. A second terminal of the switch transistor 11*d* is connected to a first terminal of the EL element 15. A second terminal of the EL element 15 is connected to an electrode or a line to which the cathode voltage Vss is applied.

Note that in FIG. 35, the drive transistor 11*a* and the switch transistors 11*b* to 11*e* are p-channel transistors, but not limited thereto, and may be n-channel transistors. Furthermore, p-channel and n-channel transistors may be both included in a pixel circuit.

A first terminal of the switch transistor 11*e* is connected to the gate signal line 17*a* (23) to which the reset voltage Vref, for instance, is applied, and a second terminal of the switch transistor 11*e* is connected to the gate terminal of the drive transistor 11*a*. The gate terminal of the switch transistor 11*e* is connected to the gate signal line 17*e*.

A first terminal of the switch transistor 11*b* through which a video signal is applied to a pixel is connected to the source signal line 18, and a second terminal of the switch transistor 11*b* is connected to a first terminal of a second capacitor 19*b*. A second terminal of the second capacitor 19*b* is connected to the gate terminal of the drive transistor 11*a*. The gate terminal of the switch transistor 11*b* is connected to the gate signal line 17*b*.

A first terminal of the first capacitor 19*a* is connected to the anode voltage Vdd, and a second terminal of the first capacitor 19*a* is connected to the first terminal of the second capacitor 19*b* or the gate terminal of the drive transistor 11*a*.

A first terminal of the switch transistor 11*c* is connected to the gate terminal of the drive transistor 11*a*, and a second terminal of the switch transistor 11*c* is connected to the second terminal of the drive transistor 11*a*. The gate terminal of the switch transistor 11*c* is connected to the gate signal line 17.

A multi-gate (more than a dual gate) transistor is used for at least one of the switch transistors 11*e* and 11*c*, and the at least one of the switch transistors 11*e* and 11*c* is combined with a LDD structure, thus preventing off-leak, and favorable contrast and offset cancellation operation are achieved. Furthermore, favorably highly-bright display and favorable image display are achieved.

The gate signal line 17*a* and gate signal line 17*b* are double-sided driven by the gate driver circuits 12*a* and 12*b*.

In the EL display apparatus illustrated in FIG. 35, the gate signal line 17*b* to which the switch transistor 11*b* which applies a video signal to the pixel 16 is connected is double-sided driven. Furthermore, the gate signal line 17*a* to which the switch transistor 11*e* is connected is double-sided driven, thus supplying the gate signal line 17*a* with a favorable reference voltage (Vref). By the double-sided driving, in portions of a display screen, a reference voltage (Vref) which prevents occurrence of a voltage drop in the gate signal line 17*a*, or gives no or less voltage drop can be applied to pixels 16.

The driving method as described above may be applied to the pixel circuit configuration as illustrated in, for instance, FIG. 35. Furthermore, the pixel circuit configuration may be combined with another embodiment.

The above may be applied not only to the pixel configuration in FIG. 35, but to other pixel configurations. Another driving method different from those described in the above embodiments may be applied to the image display device.

In the pixel 16 illustrated in FIG. 35, the first terminal of the drive transistor 11*a* is connected to an electrode or a line to which the anode voltage Vdd is applied, and the second terminal of the drive transistor 11*a* is connected to the anode terminal of the EL element 15. The second terminal of the EL element 15 is connected to an electrode or a line to which the cathode voltage Vss is applied.

The first terminal of the switch transistor 11*e* is connected to the gate signal line 17*a* (23) to which the reset voltage Vref, for instance, is applied, and the second terminal of the switch transistor 11*e* is connected to the gate terminal of the drive transistor 11*a*. Furthermore, the gate terminal of the switch transistor 11*e* is connected to the gate signal line 17*e*.

The first terminal of the switch transistor 11*b* which applies a video signal to a pixel is connected to the source signal line 18, and the second terminal of the switch transistor 11*b* is connected to the gate terminal of the drive transistor 11*a*. The gate terminal of the switch transistor 11*b* is connected to the gate signal line 17*b*.

The gate signal line 17*e* and the gate signal line 17*b* are double-sided driven by the gate driver circuits 12*a* and 12*b*. The gate driver circuit 12*a* and the gate driver circuit 12*b* temporally switch and apply plural types of voltages such as the reference voltage (Vref=VpH) and the reverse bias voltage (Vnv=VpL) to the gate signal line 17*a*.

As described above, the EL display apparatus according to the present embodiment includes, in the gate driver circuits 12*a* and 12*b*, the scanning buffer circuit 21*a* (22) which outputs the on voltage and the off voltage, and the scanning buffer circuit 21*b* which outputs two types of voltages (for example, the reference voltage Vref, and the reverse bias voltage VnV) supplied to, for instance, the gate terminal of a drive transistor. As described with reference to FIG. 28, the configuration of three-gate-voltage driving supplies three types of voltages (for example, the reference voltage Vref, the reverse bias voltage VnV, and the overload voltage Vovd) supplied to, for instance, the gate terminal of a drive transistor.

The above matters may be applied to another embodiment, or may be combined with another embodiment.

Figure 36:
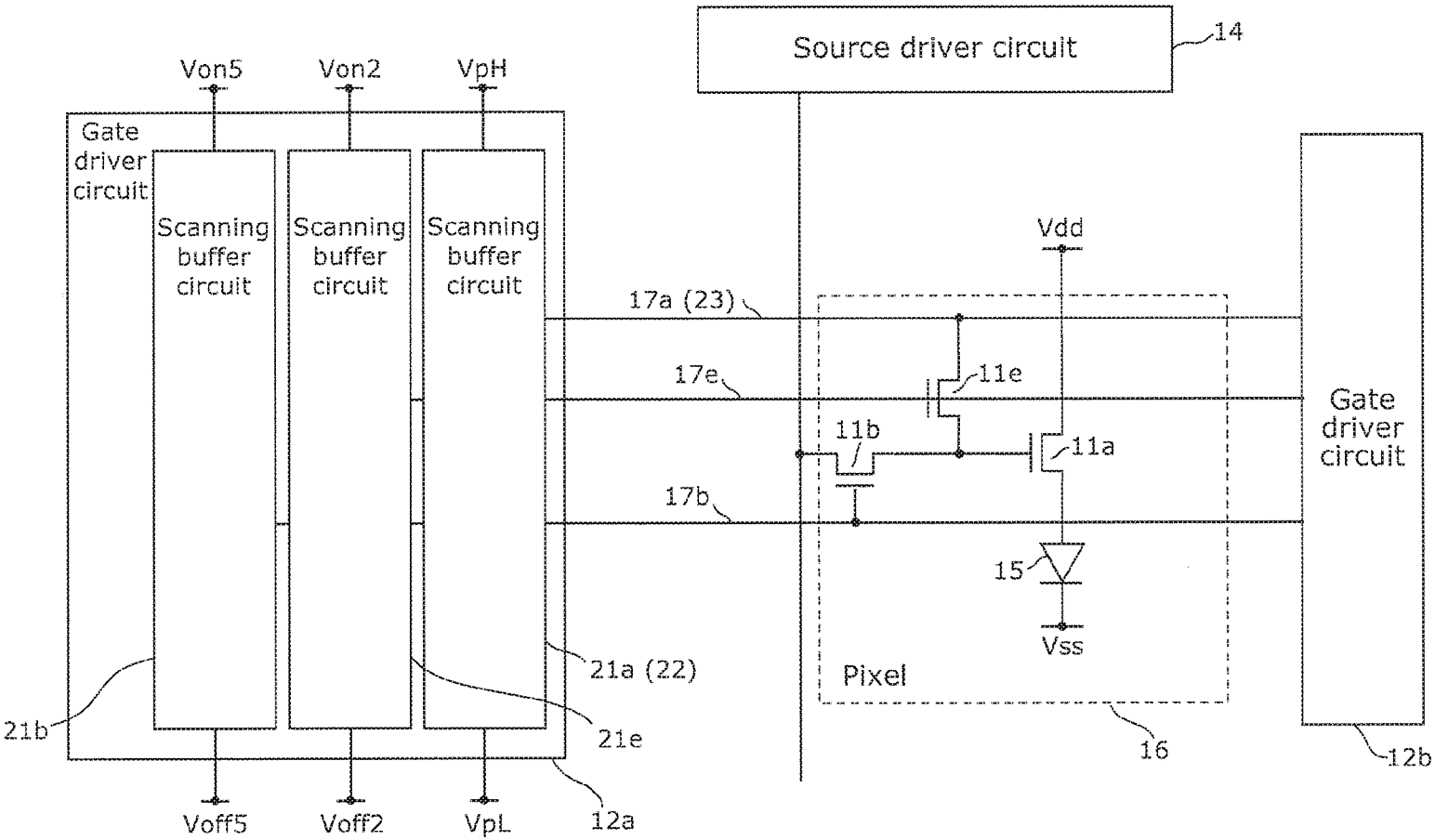
FIG. 36 is a configuration diagram of an EL display apparatus according to another embodiment.

The following describes another embodiment of the EL display apparatus with reference to FIG. 36. FIG. 36 illustrates an example in which three transistors are included in the pixel 16. In the EL display apparatus according to FIG. 36, three gate signal lines (17*a*, 17*e*, 17*b*) are formed in the pixel 16.

The gate driver circuits 12*a* and 12*b* are disposed for the gate signal lines 17*e*, 17*a*, and 17*b*.

Thus, the gate signal lines 17*a*, 17*b*, and 17*e* are double-sided driven by the gate driver circuits 12*a* and 12*b*. Three-gate-voltage driving is performed on the gate signal line 17*b*. Note that two-gate-voltage driving is performed on the gate signal line 17*e*. The gate driver circuit 12*a* supplies the reference voltage (Vref) or the reverse bias voltage (Vnv) to the switch transistor 11*e* through the gate signal line 17*a*.

Figure 37:
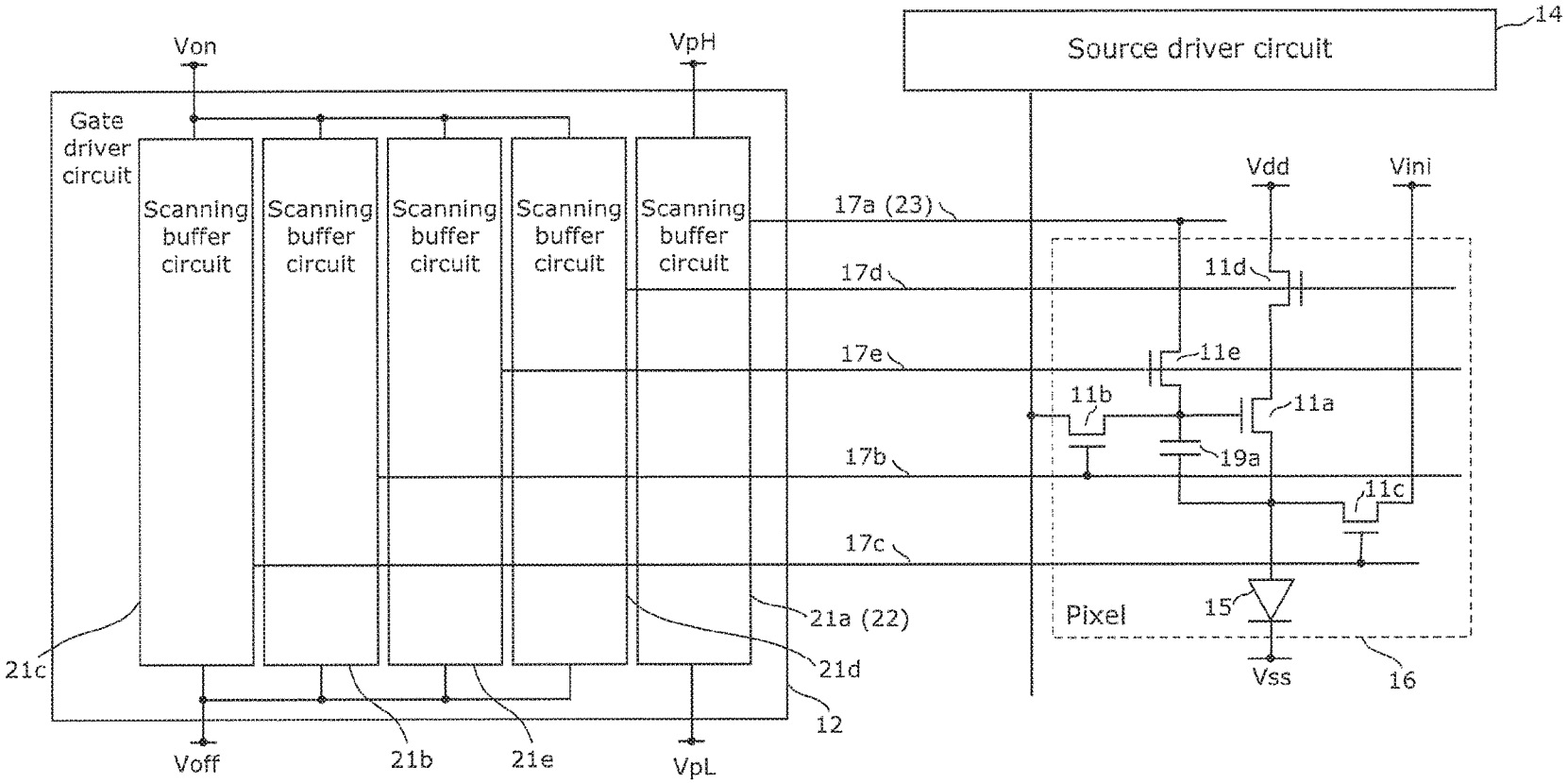
FIG. 37 is a configuration diagram of an EL display apparatus according to another embodiment.

The following describes another embodiment of the EL display apparatus with reference to FIG. 37. The EL display apparatus illustrated in FIG. 37 is a variation of the configuration described with reference to FIG. 29.

Specifically, as illustrated in FIG. 37, five scanning buffer circuits 21 (21*a* (22), 21*b*, 21*c*, 21*d*, 21*e*) are formed in the gate driver circuit (gate driver IC) 12. The VpH and VpL voltages are supplied to the scanning buffer circuit 21*a*, and the scanning buffer circuit 21*a* outputs the VpH voltage or the VpL voltage to the gate signal line 17*a*, in synchronization with a clock CIk signal or a one pixel-row selection signal.

The Von and Voff voltages are supplied in common to the scanning buffer circuits 21*d*, 21*e*, 21*b*, and 21*c*, and the scanning buffer circuits 21*d*, 21*e*, 21*b*, and 21*c* output the Von voltage or the Voff voltage to the gate signal lines 17*d*, 17*e*, 17*b*, and 17*c*, in synchronization with a clock Clk signal or a one pixel-row selection signal.

As described above, by adopting a configuration in which the Von voltage and the Voff voltage are supplied in common to the scanning buffer circuits 21, the number of terminals of the gate driver circuit 12 can be reduced and COF lines 221 of a COF 34 can be decreased.

The switch transistor 11*e* is formed in the pixel 16, and a terminal of the switch transistor 11*e* is connected to the drive transistor 11*a*. Another terminal of the switch transistor 11*e* is connected to the gate signal line 17*a*. The scanning buffer circuit 21*a* of the gate driver circuit 12 supplies the reference voltage VpH or the reverse bias voltage VpL to the gate signal line 17*e*. By using the reference voltage VpH, offset cancellation operation of the drive transistor 11*a* is performed, thus achieving favorable gradation display. Furthermore, in a period other than the display period, the reverse bias voltage (Vnv) is applied to the gate terminal of the drive transistor 11*a* via the switch transistor 11*e*. By applying the reverse bias voltage (Vnv) to a drive transistor, a change in the rise voltage (VT voltage) of the drive transistor can be prevented.

The present embodiment has mainly given a description showing, as an example, a method of applying a video signal voltage to pixels 16 (program voltage method). However, the present embodiment is not limited to this. A method of applying a video signal current to pixels 16 (program current method) may be adopted. Furthermore, as pulse width modulation (PWM) driving, a digital drive system for display by causing the pixels 16 to blink or digitally causing the pixels 16 to emit light may be adopted. Alternatively, another driving method may be adopted. The method may be emission area variable driving with which light emission intensity is represented by a light-emission area.

An example of PWM driving is a method for gradation display by applying a voltage having a predetermined value to the pixel 16 using the switch transistor 11*b*, and tuning on and off the switch transistor 11*d* based on the value of the voltage corresponding to gradation.

Belt-shaped black display (non-display) is generated on a display screen 24 by controlling on and off of the switch transistor 11*d*, thus controlling the amount of current flowing into the display screen 24.

A configuration may be adopted in which anode voltage Vdd can be changed based on the magnitude of current flowing through the display screen 24. If the current flowing through the display screen 24 is greater than a predetermined value, the anode voltage Vdd is decreased so that less power is consumed by the panel. If the current flowing through the display screen 24 is less than the predetermined value, the anode voltage Vdd is increased or maintained at a predetermined voltage. Thus, the magnitude of current is controlled such that a prescribed current flows through the EL element 15 of each pixel 16.

In the EL display apparatus according to the present embodiment, red (R), green (G), and blue (B) color filters are formed in correspondence with the positions of pixels 16. Note that the color filters are not limited to RGB color filters, and cyan (C), magenta (M), and yellow (Y) pixels may be formed. Also, a white (W) pixel may be formed. In other words, R, G, B, and W pixels are disposed in a matrix on the display screen 24.

Pixels can be formed such that 3 pixels, namely RGB pixels form a square. Accordingly, R, G, and B pixels each have an oblong shape. Accordingly, annealing is performed by making the laser irradiation spot oblong, and thus variations of characteristics of transistors within one pixel do not occur.

Note that the apertures of R, G, and B pixels may be different. Different apertures can make densities of current flowing through the EL elements 15 of RGB pixels different. By making current densities different, the speed of degradation of the EL elements 15 can be made the same for RGB pixels. If the speed of degradation is the same, occurrence of a difference in white balance of a display device is prevented.

A white (W) pixel is formed if necessary. In other words, pixels include R, G, B, and W pixels, Higher brightness can be achieved by including R, G, B, and W pixels, Another example is a configuration which includes R, G, B, and G pixels.

The EL display apparatus according to the present embodiment may have pixels 16W having a white (W) color, in addition to pixels of the three primary colors, namely, RGB pixels. Favorable color peak luminance can be achieved by forming or disposing the pixels 16W. In addition, highly bright display can be achieved, A display device is colorized by mask deposition, yet colorization of the EL display apparatus is not limited to this. For example, an EL layer which emits blue light is formed, and R, G, and B color conversion layers (CCM: color changing media) may be used to convert the emitted blue light into R light, G light, and B light.

Note that a circularly polarizing plate (circularly polarizing film) (not illustrated) can be disposed on a light emitting surface of a display device. A combination of a polarizing plate and a phase film is referred to as a circularly polarizing plate (circularly polarizing film).

The above embodiment may be applied to other embodiments, or may be combined with other embodiments.

A configuration (or may be a portion of the configuration) of the EL display apparatus described with reference to the drawings illustrating the embodiments described above may be applied to various electronic devices. Specifically, such a configuration is applicable to display units of electronic devices.

Such electronic devices include: a video camera, a digital camera, a goggles-type display, a navigation system, a sound playback (such as a car audio or an audio component stereo), a computer, a game machine, a mobile information terminal (such as a mobile computer, a mobile phone, a handheld game machine, or an electronic book), and image reproducer which includes a recording medium (specifically, a device which plays a recording medium such as a digital versatile disc (DVD) and includes a display which can display an image stored in the DVD).

Figure 38:
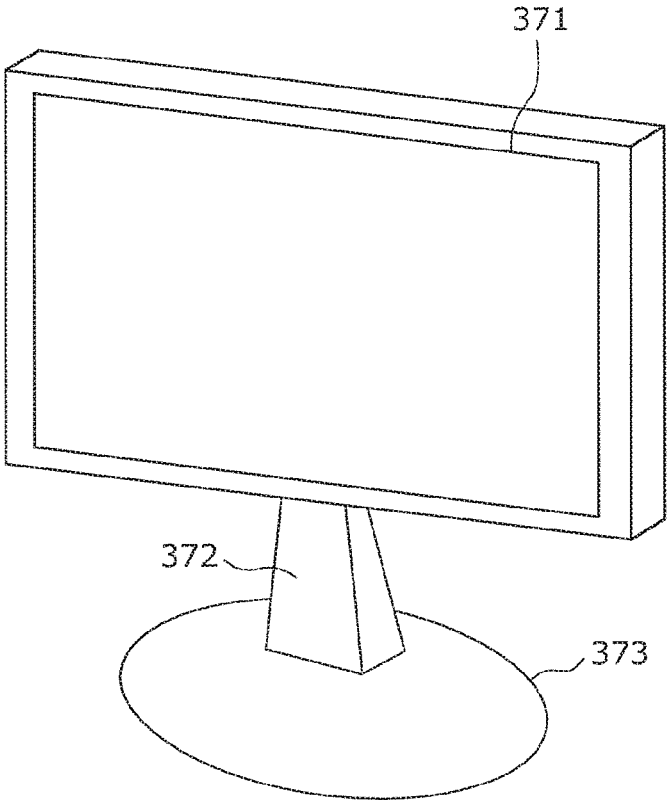
FIG. 38 is an overall view a display which includes an EL display apparatus according to another embodiment.

FIG. 38 is an overview of a display for which the EL display apparatus according to the embodiment is used. The display illustrated in FIG. 38 includes a case 372, a holding stand 373, and an EL display apparatus (EL display panel) 371 according to the present disclosure. The display illustrated in FIG. 38 has a function of displaying various pieces information (such as a still image, video, and a text image) on the display. Note that the functions of the display illustrated in FIG. 38 are not limited to these, and the display may have various functions.

Figure 39:
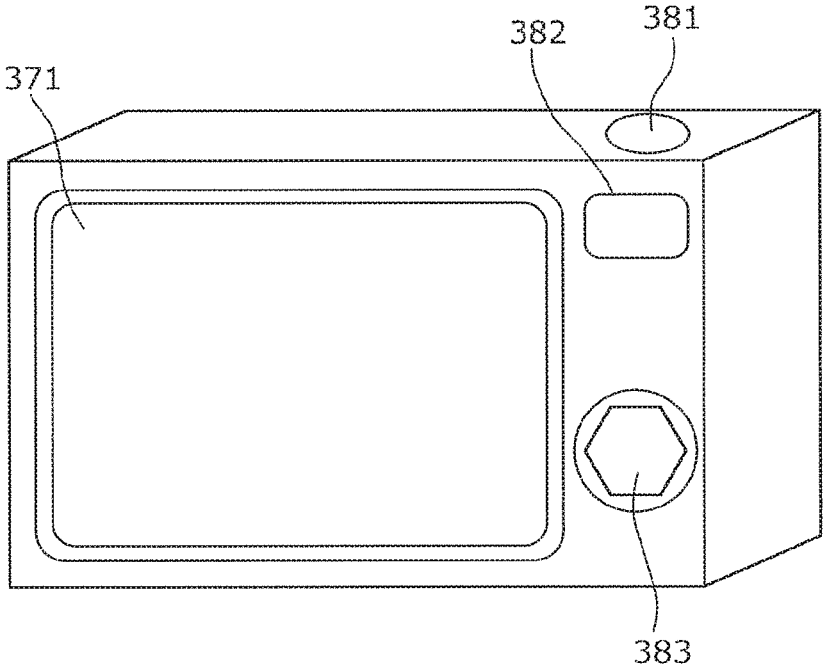
FIG. 39 is an overall view of a camera which includes an EL display apparatus according to another embodiment.

FIG. 39 is an overview of a camera for which the EL display apparatus according to the embodiment is used. The camera illustrated in FIG. 39 includes a shutter 381, a viewfinder 382, and a cursor 383. The camera illustrated in FIG. 39 has a function of capturing a still image, and also a function of capturing video. Note that the functions of the camera illustrated in FIG. 39 are not limited to these, and the camera may have various functions.

Figure 40:
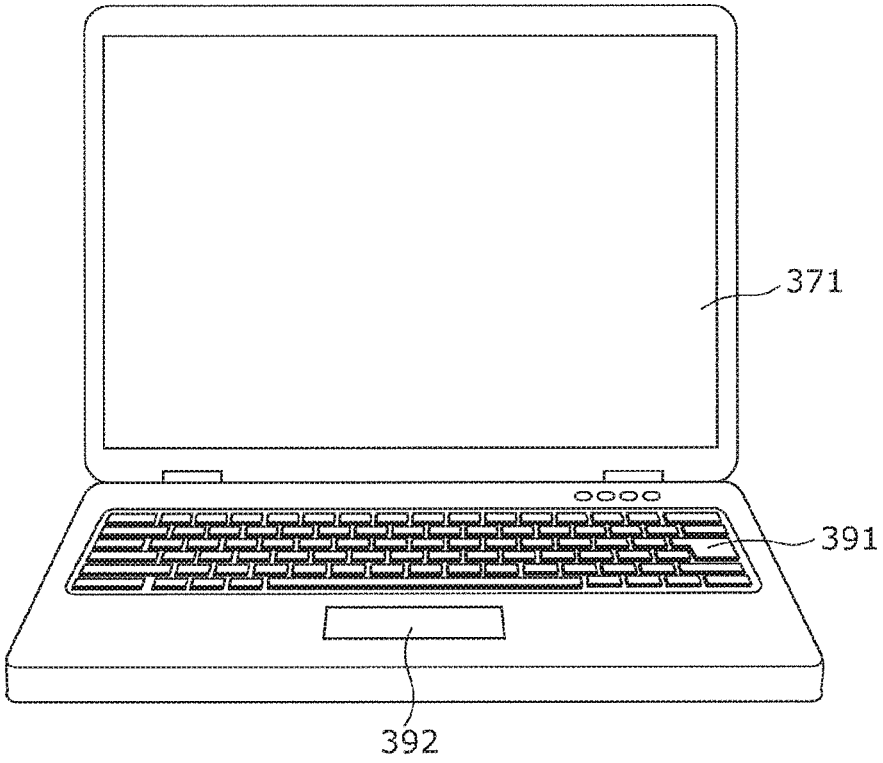
FIG. 40 is an overall view of a computer which includes an EL display apparatus according to another embodiment.

FIG. 40 is an overview of a computer for which the EL display apparatus according to the embodiment is used. The computer illustrated in FIG. 40 includes a keyboard 391 and a touchpad 392. The computer illustrated in FIG. 40 has a function of displaying various pieces of information (such as a still image, video, and a text image) on a display unit. Note that the functions of the computer illustrated in FIG. 40 are not limited to these, and the computer may have various functions.

By adopting a configuration in which the EL display apparatus (display panel) or the drive system described in the above embodiments is used for a display unit of such an electronic device, higher definition of and a reduction of the cost of the above-mentioned information device and others as illustrated in FIGS. 38, 39, and 40 can be achieved. Furthermore, such a device can be inspected and adjusted with ease.

The above embodiments and variations can be combined with other embodiments as appropriate.

For example, as the EL display apparatus 371 which is a laptop personal computer illustrated in FIG. 40, the EL display apparatus (display panel) illustrated and described in the present embodiment may be employed. Furthermore, an information device may include the EL display apparatus (display panel) illustrated and described in the present embodiment.

Note that the above embodiments have given a description assuming that the device is an EL display apparatus. However, the technical idea stated in the present disclosure may be applied not only to the EL display apparatus, but also to another display device.

The matters stated in the present disclosure are not limited only to an EL display apparatus which includes an EL element. For example, the disclosure is applicable to other displays such as a liquid crystal display device, a field emission display (FED), and a surface-conduction electron-emitter display (SED).

The concept of the EL display apparatus according to the present embodiment includes system devices such as information devices. The concept of a display panel includes system devices such as information devices, in a broad sense.

The above has described embodiments as examples of the technology according to the present disclosure. The accompanying drawings and detailed description are provided therefore.

Accordingly, the elements illustrated in the accompanying drawings and stated in the detailed description include not only an element necessary to address problems, but also an element which is not necessary to address problems in order to exemplify the technology. Accordingly, by the mere fact that such an element not necessary to address the problems is illustrated in an accompanying drawing and described in the detailed description, the element should not be immediately determined to be required.

The above embodiments are intended to show examples of the technology according to the present disclosure, and thus various changes, replacement, addition, and omission, for instance, can be made within the scope or the claims and the equivalents thereof.

INDUSTRIAL APPLICABILITY

The EL display apparatus according to the present disclosure is useful in particular to an active-type organic EL flat-panel display.

The invention claimed is:

1. An electroluminescent (EL) display apparatus, comprising:

a display screen in which pixels are disposed in a matrix, the pixels each including an EL element, a drive transistor which supplies the EL element with a current, and a switch transistor having a source terminal and a drain terminal one of which is connected to a gate terminal of the drive transistor;

a source driver circuit which outputs a video signal to be applied to the pixels;

a source signal line for transmitting the video signal output by the source driver circuit to the gate terminal of the drive transistor;

a gate driver circuit which supplies the switch transistor with a control signal;

a first gate signal line for supplying the other of the source terminal and the drain terminal of the switch transistor with a voltage from the gate driver circuit; and a second gate signal line for supplying the gate terminal of the switch transistor with the control signal from the gate driver circuit, wherein the gate driver circuit applies, to the second gate signal line, an on voltage which places the switch transistor in an operating state or an off voltage which places the switch transistor in a non-operating state, the gate driver circuit applies, to the first gate signal line, a first voltage or a second voltage, and the drive transistor is placed in a first state by the gate driver circuit applying the first voltage to the gate terminal of the drive transistor while the switch transistor is on, and is placed in a second state by the gate driver circuit applying the second voltage to the gate terminal of the drive transistor while the switch transistor is on, wherein the first voltage is a reference voltage (Vref) and the second voltage is a reverse bias voltage (Vnv).

2. The EL display apparatus according to claim 1, wherein the first voltage is a positive voltage, and the second voltage is a negative voltage.

3. The EL display apparatus according to claim 1, wherein the gate driver circuit places the first gate signal line in a high impedance state without outputting the first voltage and the second voltage, in between when the drive transistor is placed in the first state and when the drive transistor is placed in the second state.

4. A method for driving an electroluminescent (EL) display apparatus that includes a display screen in which pixels are disposed in a matrix, the pixels each including an EL element, a drive transistor which supplies the EL element with a current, and a switch transistor which places the drive transistor in an operating state or a non-operating state;

a gate driver circuit which supplies the switch transistor with a voltage and a control signal for placing the switch transistor in an operating state or a non-operating state;

a first gate signal line for supplying the switch transistor with the voltage from the gate driver circuit; and a second gate signal line for supplying the switch transistor with the control signal from the gate driver circuit, the method comprising:

placing the drive transistor in a first state by the gate driver circuit applying a first voltage to a gate terminal of the drive transistor while the switch transistor is in the operating state; and placing the drive transistor in a second state by the gate driver circuit applying a second voltage to the gate terminal of the drive transistor while the switch transistor is in the operating state, wherein the first voltage is a reference voltage (Vref) and the second voltage is a reverse bias voltage (Vnv).

5. The method according to claim 4, wherein the first voltage output by the gate driver circuit is a positive voltage, and the second voltage output by the gate driver circuit is a negative voltage.

6. The method according to claim 4, wherein the gate driver circuit places the first gate signal line in a high impedance state without outputting the first voltage and the second voltage, in between when the drive transistor is placed in the first state and when the drive transistor is placed in the second state.

7. The EL display apparatus according to claim 2, wherein the gate driver circuit places the first gate signal line in a high impedance state without outputting the first voltage and the second voltage, in between when the drive transistor is placed in the first state and when the drive transistor is placed in the second state.

8. The method according to claim 5, wherein the gate driver circuit places the first gate signal line in a high impedance state without outputting the first voltage and the second voltage, in between when the drive transistor is placed in the first state and when the drive transistor is placed in the second state.

* * * * *